US012441565B2

(12) United States Patent
Ramadhan et al.

(10) Patent No.: US 12,441,565 B2
(45) Date of Patent: Oct. 14, 2025

(54) FEEDING DEVICE, PRINTING APPARATUS AND METHOD OF CONTROLLING FEEDING DEVICE

(71) Applicant: SEIKO EPSON CORPORATION, Tokyo (JP)

(72) Inventors: Ahmad Adam Zari Ardi Ramadhan, Jakarta Selatan (ID); Indo Permana Putra, Subang (ID)

(73) Assignee: Seiko Epson Corporation, Tokyo (JP)

( * ) Notice: Subject to any disclaimer, the term of this patent is extended or adjusted under 35 U.S.C. 154(b) by 189 days.

(21) Appl. No.: 18/188,248

(22) Filed: Mar. 22, 2023

(65) Prior Publication Data

US 2023/0303348 A1 Sep. 28, 2023

(30) Foreign Application Priority Data

Mar. 24, 2022 (JP) ..... 2022-047980
Mar. 24, 2022 (JP) ..... 2022-047981

(51) Int. Cl.
*B65H 5/06* (2006.01)
*B65H 5/00* (2006.01)

(52) U.S. Cl.
CPC ..... *B65H 5/002* (2013.01); *B65H 2551/15* (2013.01); *B65H 2551/20* (2013.01); *B65H 2557/652* (2013.01)

(58) Field of Classification Search
CPC . B65H 3/06; B65H 5/06; B65H 5/062; B65H 5/064; B65H 2511/212; B65H 2551/15; B65H 2551/20; B65H 2402/44; B65H 2402/45; B65H 2402/441; B65H 2402/60; B65H 2601/324; B65H 2601/321; B65H 2801/12; B41J 13/076
See application file for complete search history.

(56) References Cited

U.S. PATENT DOCUMENTS

| | | | | |
|---|---|---|---|---|
| 7,913,996 | B2 * | 3/2011 | Nishikata | B65H 3/0638 271/145 |
| 8,196,917 | B2 * | 6/2012 | Shiba | B65H 7/02 271/265.01 |
| 8,439,353 | B2 * | 5/2013 | Tamehira | G03G 15/6505 271/145 |
| 9,434,564 | B2 * | 9/2016 | Yokoyama | B65H 5/062 |
| 10,486,922 | B2 * | 11/2019 | Horita | B65H 3/0684 |
| 10,584,006 | B2 * | 3/2020 | Suzuki | B65H 5/062 |
| 11,427,419 | B2 * | 8/2022 | Uchida | B65H 3/06 |

FOREIGN PATENT DOCUMENTS

| | | |
|---|---|---|
| JP | H08-087211 A | 4/1996 |
| JP | H11-208907 A | 8/1999 |

* cited by examiner

*Primary Examiner* — Leslie A Nicholson, III
(74) *Attorney, Agent, or Firm* — WORKMAN NYDEGGER

(57) ABSTRACT

A feeding device includes a housing, a sheet feeder tray that mounts a sheet, a feeding unit which transports the sheet from the sheet feeder tray, and is detachable from a rotating shaft, and a control unit that controls rotation of the feeding unit. The feeding unit is provided in such a way as to be turnable to a feeding position to transport the sheet mounted on the sheet feeder tray and to a replacement position to enable detachment from the rotating shaft. When replacing the feeding unit, the control unit switches the position of the feeding unit to the replacement position.

19 Claims, 21 Drawing Sheets

FEEDING DEVICE, PRINTING APPARATUS AND METHOD OF CONTROLLING FEEDING DEVICE

The present application is based on, and claims priority from JP Application Serial Number 2022-047981, filed Mar. 24, 2022 and JP Application Serial Number 2022-047980, filed Mar. 24, 2022, the disclosures of which are hereby incorporated by reference herein in their entirety.

BACKGROUND

1. Technical Field

The present disclosure relates to a feeding device, a printing apparatus, and a method of controlling a feeding device.

2. Related Art

JP-A-11-208907 discloses a sheet feeding device representing an example of a feeding device that includes a friction roller unit and a sheet feeding shaft to support the friction roller unit, and is configured to feed a sheet. JP-A-11-208907 also discloses a structure in which the friction roller unit is attachable to and detachable from the sheet feeding shaft. The friction roller unit is an example of a feeding unit, the sheet feeding shaft is an example of a rotating shaft, and the sheet is an example of a medium.

However, a user may not be able to enjoy usability from the sheet feeding device that includes the friction roller unit that is attachable to and detachable from the sheet feeding shaft as disclosed in JP-A-11-208907.

SUMMARY

A feeding device includes: a device body; a mounting unit that mounts a medium; a feeding unit that transports the medium from the mounting unit, the feeding unit being configured to be detached from a rotating shaft and including a feed roller portion that comes into contact with the medium and transports the medium, and an engaged portion to be engaged with an engaging portion provided to the rotating shaft that rotates the feed roller portion; and a control unit that controls rotation of the feeding unit, in which the feeding unit is provided in the device body and configured to be turned to a feeding position to transport the medium mounted on the mounting unit and to a replacement position to enable detachment from the rotating shaft, and the control unit switches a position of the feeding unit to the replacement position when replacing the feeding unit.

A printing apparatus includes: the above-mentioned feeding device; and a printing unit that performs printing on the transported medium.

A method of controlling a feeding device provided with a mounting unit that mounts a medium, a feeding unit that transports the medium from the mounting unit, the feeding unit being configured to be detached from the rotating shaft and including a feed roller portion that comes into contact with the medium and transports the medium, and an engaged portion to be engaged with an engaging portion provided to a rotating shaft that rotates the feed roller portion, includes: switching a position of the feeding unit from a feeding position to transport the medium mounted on the mounting unit to a replacement position to enable detachment from the rotating shaft when replacing the feeding unit.

DESCRIPTION OF EXEMPLARY EMBODIMENTS

Figure 1:
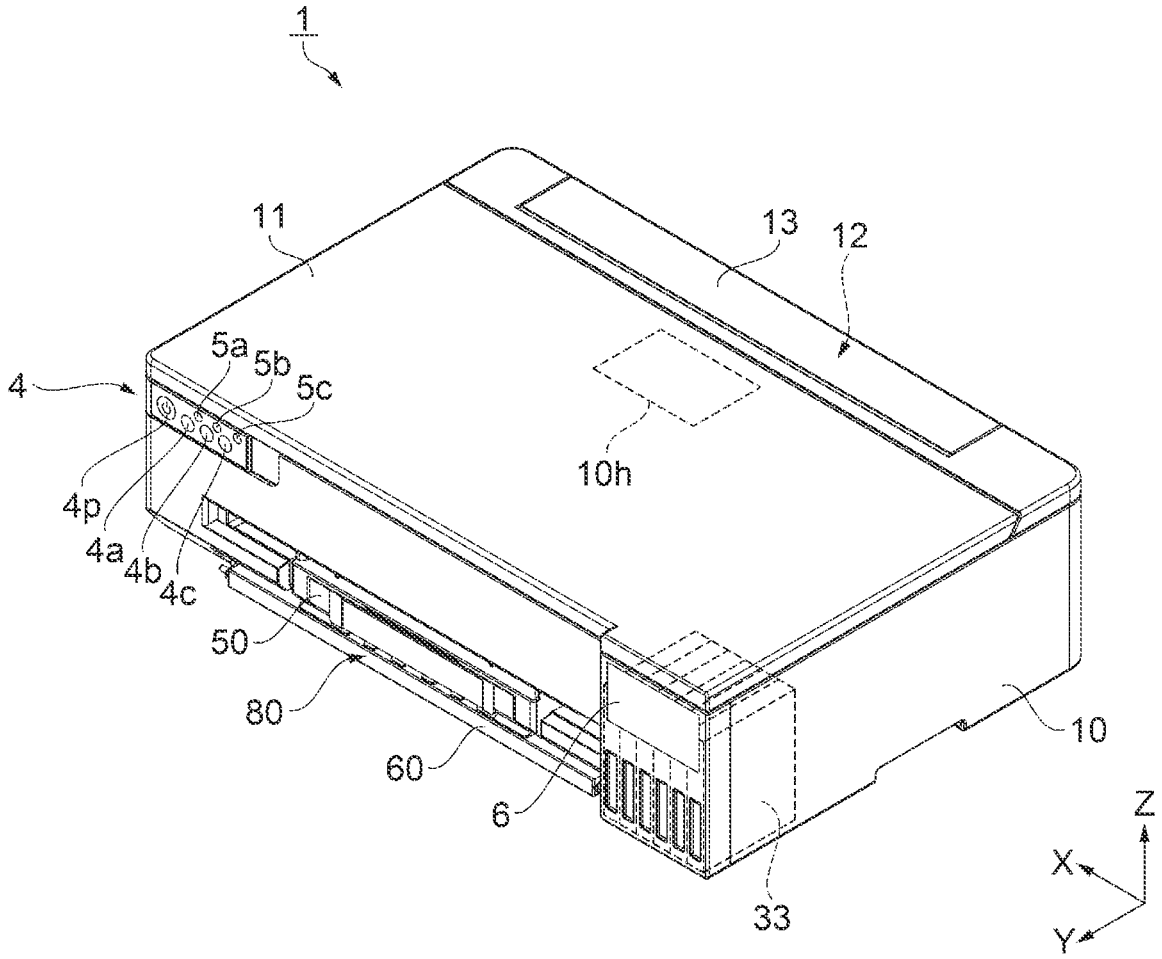
FIG. 1 is a perspective view illustrating a configuration of external appearance of a printing apparatus as an embodiment of the present disclosure.

The present disclosure will be described below based on an embodiment. In the drawings, the same constituents are designated by the same reference signs and overlapping explanations will be omitted. It is to be noted that the expressions "the same", "identical", and "simultaneous" do not only mean strictly the same things and timings but also encompass the same things and timings while taking into account certain measurement errors, the same things while taking into account production tolerances of components, and the same things and timings within the scope not damaging intended functions. In this regard, the expression "the two components have the same dimensions" means that a difference in dimension between the components is within ±10%, more preferably ±5%, or even more preferably ±3% of a dimension of one of the components, for example.

In the drawings, x, y, and z represent three spatial axes that are orthogonal to one another. In the present specification, directions along these axes are defined as x-axis direction, y-axis direction, and z-axis direction, respectively. When orientations of such directions are specified, positive and negative signs, namely, "+" for positive and "−" for negative are added to the directional expressions. Hence, an orientation indicated with an arrow will be explained as + direction and a direction opposite to such an arrow will be explained as − direction.

Here, the z-axis direction represents a direction of gravitational force. The +z direction means vertically upward and the −z direction means vertically downward. Meanwhile, a plane that includes the x axis and the y axis will be explained as x-y plane, a plane that includes the x axis and the z axis will be explained as x-z plane, and a plane that includes the y axis and the z axis will be explained as y-z plane, respectively. Here, the x-y plane is equivalent to a horizontal plane. Moreover, the three spatial axes of the x, y, and z axes without limitations of the positive direction or negative direction will be described as the x axis, the y axis, and the z axis, respectively.

The x-axis direction in each of the drawings is a width direction of a housing 10 to be described later. This direction is equivalent to a direction intersecting with a direction of transportation to transport a sheet S, or in other words, a width direction of the sheet S. Of the x-axis direction, −x direction is a rightward direction and +x direction is a leftward direction from the viewpoint of a user when a front surface of the housing 10 is opposed to the user. In the present embodiment, a side surface out of side surfaces constituting the periphery of the housing 10 which is provided with an operating panel 4 constitutes the front surface of the housing 10.

The y-axis direction is a depth direction. Of the y-axis direction, −y direction is a direction from the front surface of the housing 10 toward a back surface of the housing 10. Meanwhile, of the y-axis direction, +y direction is a direction from the back surface of the housing 10 toward the front surface of the housing 10.

Embodiment 1

A printing apparatus 1 is an ink jet printer that can print on the sheet S, for example. The printing apparatus 1 of the present embodiment can print on the sheets S in A4 size and A3 size. The sheet S is an example of a medium.

As illustrated in FIG. 1, the printing apparatus 1 includes the housing 10 that constitutes an exterior package of the printing apparatus 1. An opening-closing member 11 is provided on an upper face side in the +z direction of the housing 10. In the y-axis direction, the opening-closing member 11 has the center of rotation on the back surface side being the −y direction side of the housing 10, and is provided in such a way as to be capable of opening and closing an upper part of the housing 10. The y-axis direction is an example of the depth direction of the housing 10. The housing 10 is an example of an apparatus body.

The operating panel 4 used for operating the printing apparatus 1 is provided on the front surface side being the +y direction side of the housing 10. In the x-axis direction, the operating panel 4 is provided at an end in the +x direction of the housing 10. The x-axis direction is an example of a width direction of the housing 10. The end in the +x direction of the housing 10 is an example of one end side in the x-axis direction of the housing 10. The operating panel 4 is a panel that is elongate in the x-axis direction, and is provided with operating buttons 4*p*, 4*a*, 4*b*, and 4*c* as well as light-emitting portions 5*a*, 5*b*, and 5*c*.

The operating button 4*p* is a power button used for turning on and off a power supply to the printing apparatus 1. The operating buttons 4*a*, 4*b*, and 4*c* are operating buttons for performing various settings of the printing apparatus 1. For example, the operating button 4*a* is an operating button for setting wireless connection. The operating button 4*b* is an operating button for checking a state of network connection, for example. The operating button 4*c* is an operating button for cancelling a printing operation, for example. The operating panel 4 is an example of an instruction acceptance unit IP that accepts an instruction from the user.

Meanwhile, the light-emitting portions 5*a*, 5*b*, and 5*c* are located at positions of the operating panel 4 on the +z direction side of the operating buttons 4*a*, 4*b*, and 4*c*. The respective light-emitting portions 5*a*, 5*b*, and 5*c* are made capable of being turned on and off as well as blinking. Thus, the light-emitting portions 5*a*, 5*b*, and 5*c* function as annunciators to announce guidance display for operating the printing apparatus 1 and information concerning the printing apparatus 1. Each of the light-emitting portions 5*a*, 5*b*, and 5*c* is an example of an annunciation unit.

A display unit 6 is provided on the front surface side being the +y direction side of the housing 10. The display unit 6 is provided at an end in the −x direction of the housing 10. The end in the −x direction of the housing 10 is an example of another end side in the width direction of the housing 10. The display unit 6 has a function as the annunciation unit that announces the guidance display for operating the printing apparatus 1 and the information concerning the printing apparatus 1. The display unit 6 may also be formed from a liquid crystal display module having a touch panel function. In this case, operating buttons in a radio button unit RB set to the display unit 6 collectively function as an input unit used for various settings of the printing apparatus 1. The radio button unit RB will be described later. The radio button unit RB is an example of the instruction acceptance unit IP to accept an instruction from the user. The printing apparatus 1 does not have to include the display unit 6 when the printing apparatus 1 can be coupled to an external device 201 to be described later, for example.

A sheet discharge stacker 50 to mount the sheets S discharged from the housing 10 is disposed on the front surface side being the +y direction side of the housing 10. The sheet discharge stacker 50 is configured to be drawable in the +y direction from the front surface of the housing 10. Meanwhile, a sheet feeder tray 60 and a tray 80 are retracted into the housing 10 at a portion below the sheet discharge stacker 50. The sheet feeder tray 60 and the tray 80 are configured to be drawable from the housing 10.

Figure 2:
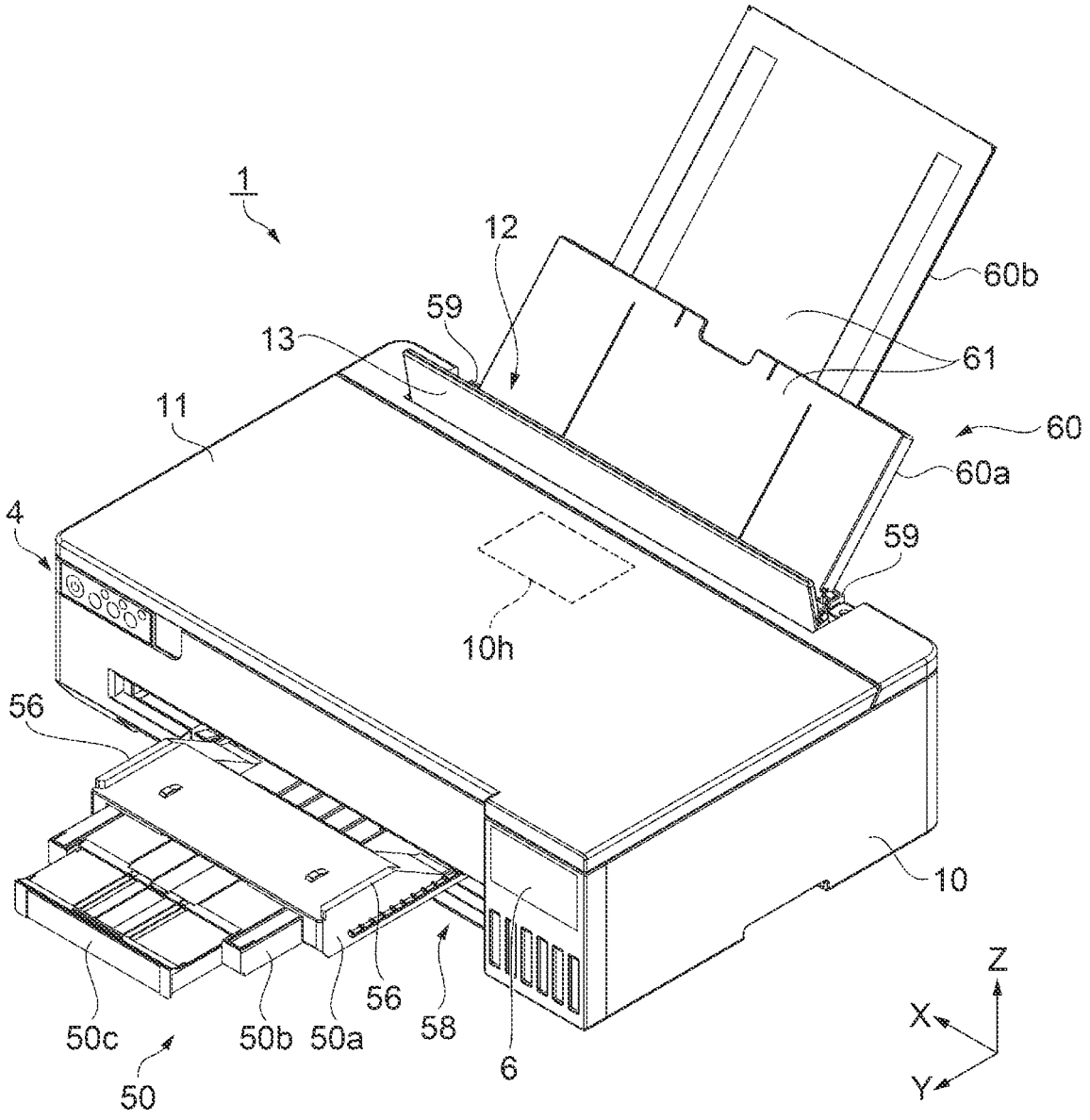
FIG. 2 is a perspective view illustrating the printing apparatus.

As illustrated in FIG. 2, the printing apparatus 1 is configured to be capable of feeding the sheets S from the back surface side being the −y direction side of the housing 10. To be more precise, a medium feed port 12 that enables feeding of the sheets S into the housing 10 is provided at the upper part of the housing 10. The medium feed port 12 is a rectangular opening that extends in the x-axis direction. Attachment units 59 are provided to two end portions in the x direction of the medium feed port 12. The sheet feeder tray 60 that is detached from the portion below the sheet discharge stacker 50 is attached to the attachment units 59.

An opening-closing lid 13 that can open and close the medium feed port 12 is provided above the medium feed port 12. The opening-closing lid 13 is turnable around a shaft extending in the x-axis direction. The medium feed port 12 and the attachment units 59 are exposed by setting the opening-closing lid 13 to an open state, so that the sheet feeder tray 60 can be attached to the attachment units 59.

The sheet feeder tray 60 includes a sheet feeder tray body 60*a* to be attached to the attachment units 59 of the housing 10, and an extension tray 60*b* that is retractable and extendable relative to the sheet feeder tray body 60*a*. Each of the sheet feeder tray body 60*a* and the extension tray 60*b* is a plate member and includes a mounting surface 61 that can mount the sheets S. The sheet feeder tray 60 is an example of a mounting unit. The sheets S mounted on the mounting surface 61 of the sheet feeder tray 60 are transported into the housing 10 by using a transportation unit 20 to be described later.

When the sheet S is subjected to print processing, the sheet feeder tray 60 is detached from the portion below the sheet discharge stacker 50 and attached to the attachment units 59. On the other hand, when the print processing does not take place, the sheet feeder tray 60 is detached from the attachment units 59 and housed into the portion below the sheet discharge stacker 50. Likewise, when the print processing is carried out by using the tray 80, the tray 80 is detached from the portion below the sheet discharge stacker 50 and used. On the other hand, when the print processing by using the tray 80 does not take place, the tray 80 is housed into the portion below the sheet discharge stacker 50.

Figure 3:
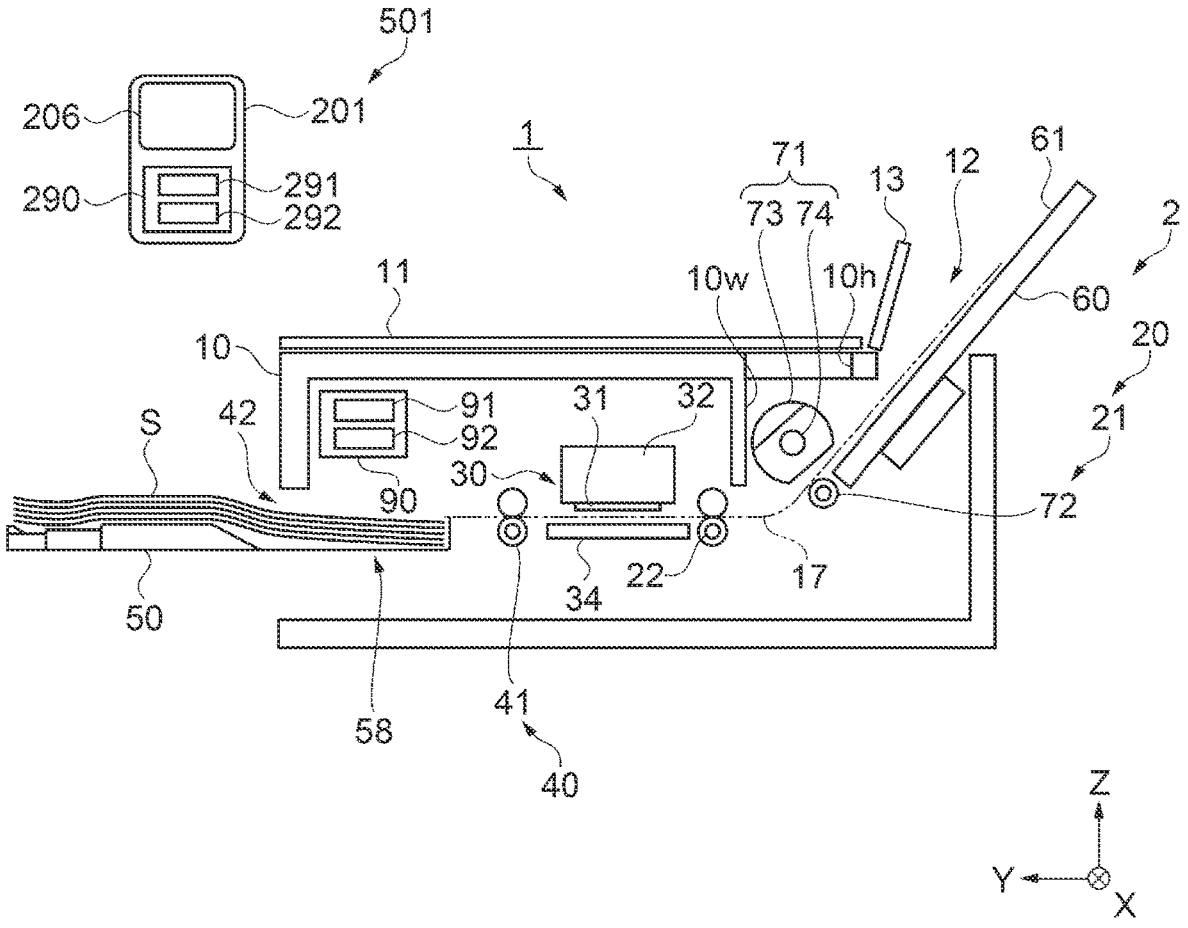
FIG. 3 is a schematic cross-sectional view illustrating the printing apparatus.

As illustrated in FIG. 3, the printing apparatus 1 includes the transportation unit 20, a printing unit 30, a discharge unit 40, and a control unit 90. A transportation route 17 to transport the sheet S is provided inside the housing 10. The sheet S is transported in the transportation route 17 along a direction of transportation. Here, a structure in the printing apparatus 1 used for transporting the sheet S toward the printing unit 30 may be referred to as a feeding device 2 as appropriate.

The transportation unit 20 is disposed downstream of the medium feed port 12. The transportation unit 20 transports the sheet S mounted on the sheet feeder tray 60 to the printing unit 30. The transportation unit 20 includes a feed roller pair 21 to be rotated in accordance with drive of a feed motor (not shown), and a transportation roller pair 22 to be rotated in accordance with drive of a transportation motor (not shown). The feed roller pair 21 and the transportation roller pair 22 are disposed along the transportation route 17, thus transporting the sheet S in the direction of transportation. Meanwhile, the mounting surface 61 of the sheet feeder tray 60 is disposed along the direction of transportation and is inclined relative to the z axis when viewed in the direction along the x axis.

The feed roller pair 21 transports the sheet S mounted on the sheet feeder tray 60 in the direction of transportation. The feed roller pair 21 is formed from a feed driving roller 71 and a feed driven roller 72. The feed driving roller 71 is formed from a feeding unit 73 that comes into contact with the sheet S and transports the sheet S, and a rotating shaft 74 that rotates the feeding unit 73.

The feeding unit 73 and an opening 10*h* are provided on the back surface side being the −y direction side relative to the center of the housing 10 in terms of the y-axis direction. The feeding unit 73 and the opening 10*h* are therefore provided at such positions that do not overlap the operating panel 4 or the display unit 6 in the y-axis direction. As illustrated in FIG. 1, the opening 10*h* is provided at a position which is located in the −x direction relative to the operating panel 4 in terms of the x-axis direction so as not to overlap the operating panel 4. Meanwhile, the opening 10*h* is provided at a position which is located in the +x direction relative to the display unit 6 in terms of the x-axis direction so as not to overlap the display unit 6. Here, the feeding unit 73 located vertically below the opening 10*h*, which is equivalent to the −z direction, is also provided at such a position that does not overlap the operating panel 4 or the display unit 6 in terms of the x-axis direction.

The user can replace the feeding unit 73 of the present embodiment. The feeding unit 73 is provided in such a way as to be attachable to and detachable from the rotating shaft 74. The feeding unit 73 is attached to and detached from the rotating shaft 74 from above the rotating shaft 74, which is equivalent to the +z direction side thereof. Accordingly, the opening 10*h* is provided at a position on an upper surface of the housing 10, which is located vertically above the feeding unit 73 being equivalent to the +z direction therefrom. As a consequence, when replacing the feeding unit 73, the user can access the feeding unit 73 through the opening 10*h* by setting the opening-closing member 11 to an open state. In other words, the housing 10 includes the opening 10*h* that exposes the feeding unit 73 to the outside.

Figure 5:
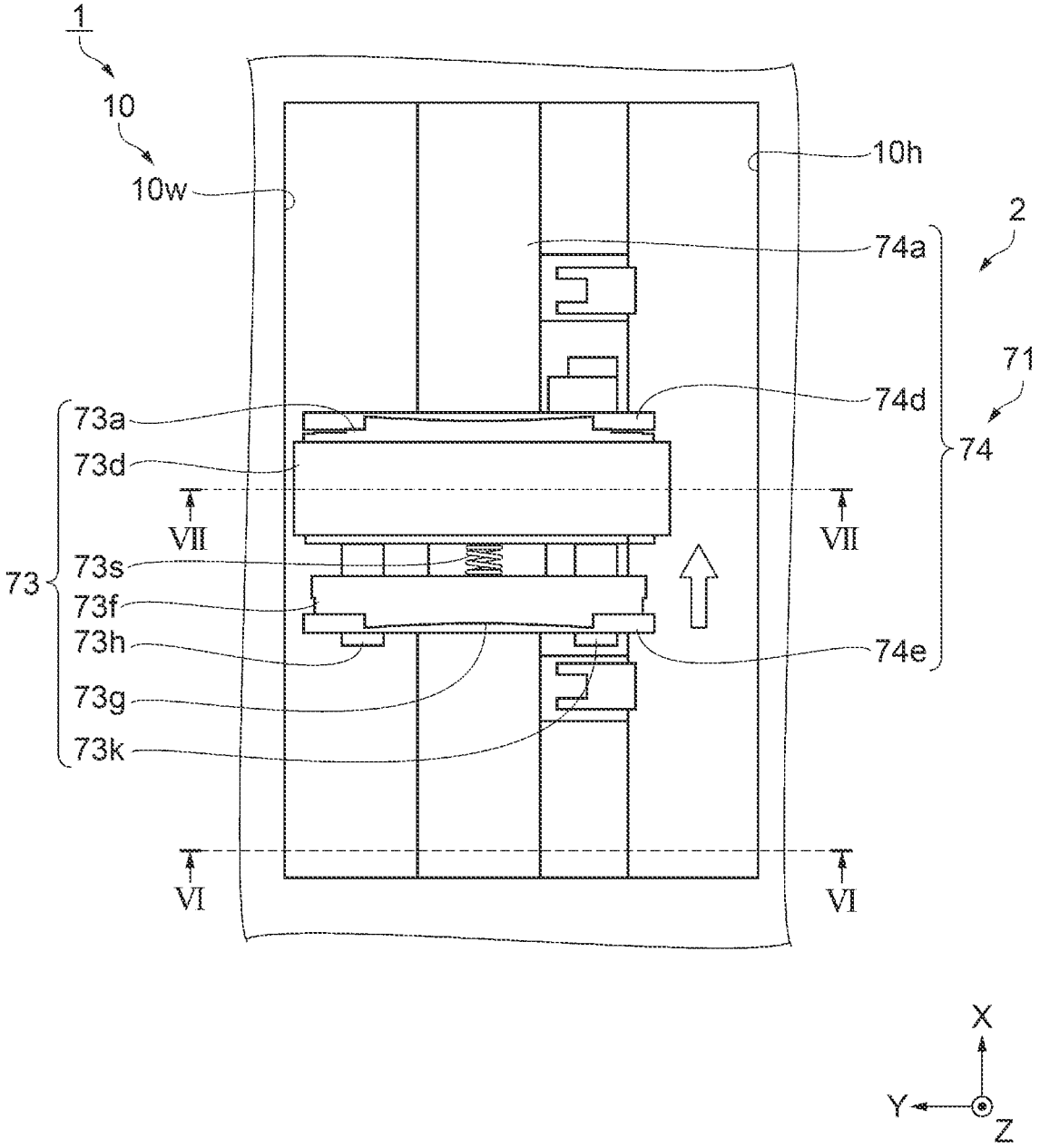
FIG. 5 is a top plan view of a feeding unit at a replacement position and a rotating shaft, which are viewed from above an opening.
Figure 6:
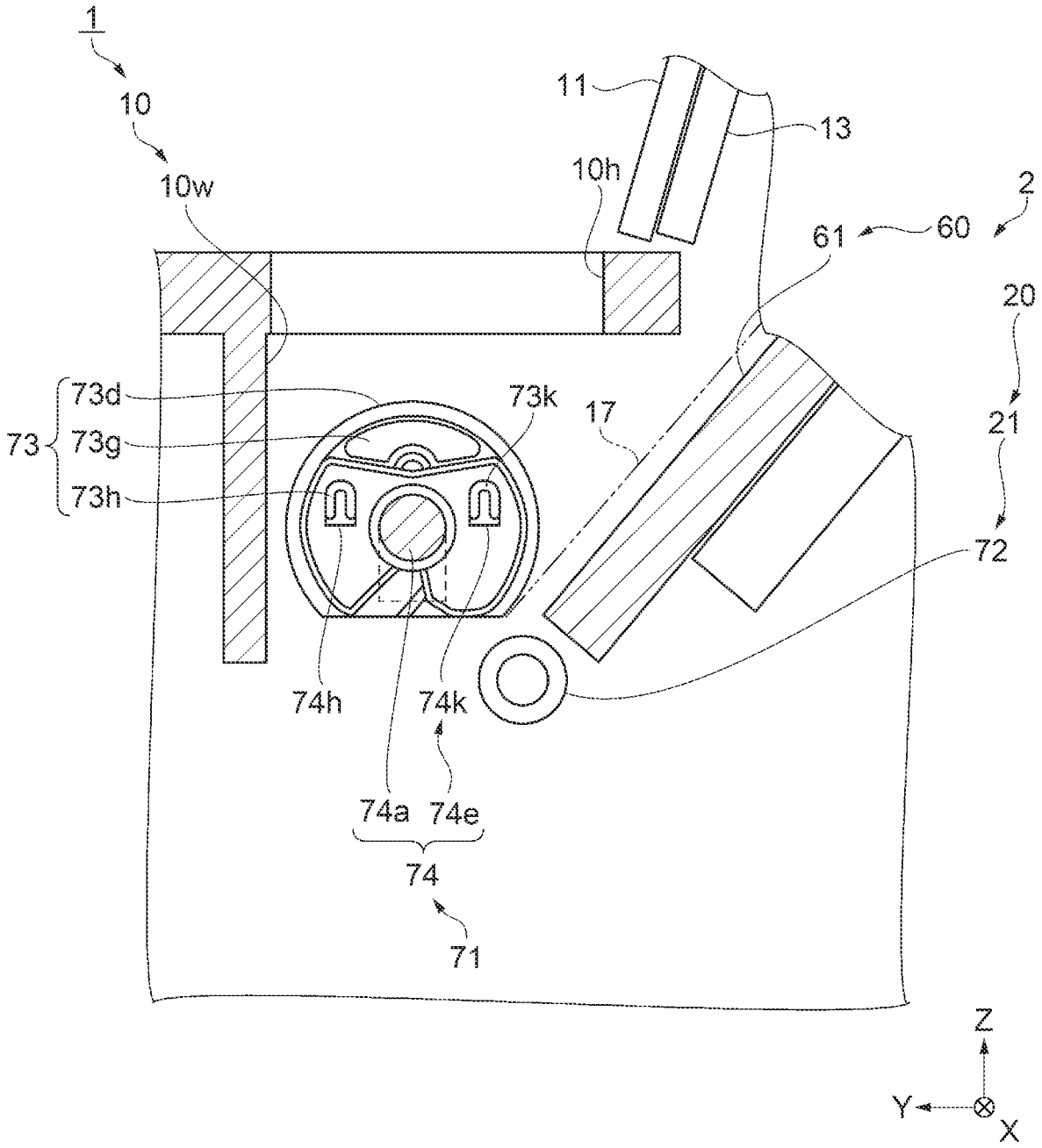
FIG. 6 is a cross-sectional view illustrating VI-VI cross-section indicated in FIG. 5.
Figure 7:
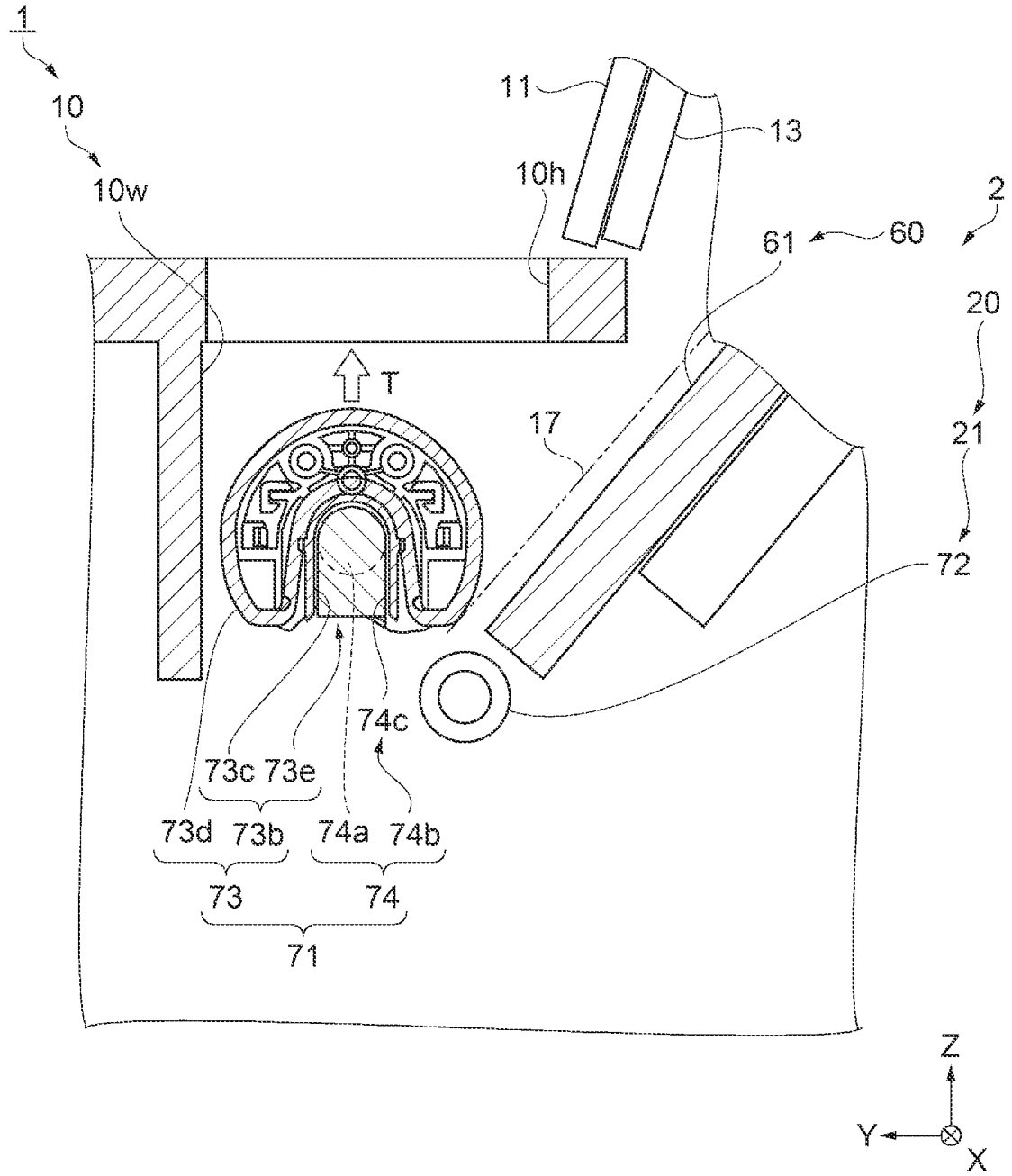
FIG. 7 is a cross-sectional view illustrating VII-VII cross-section indicated in FIG. 5.
Figure 8:
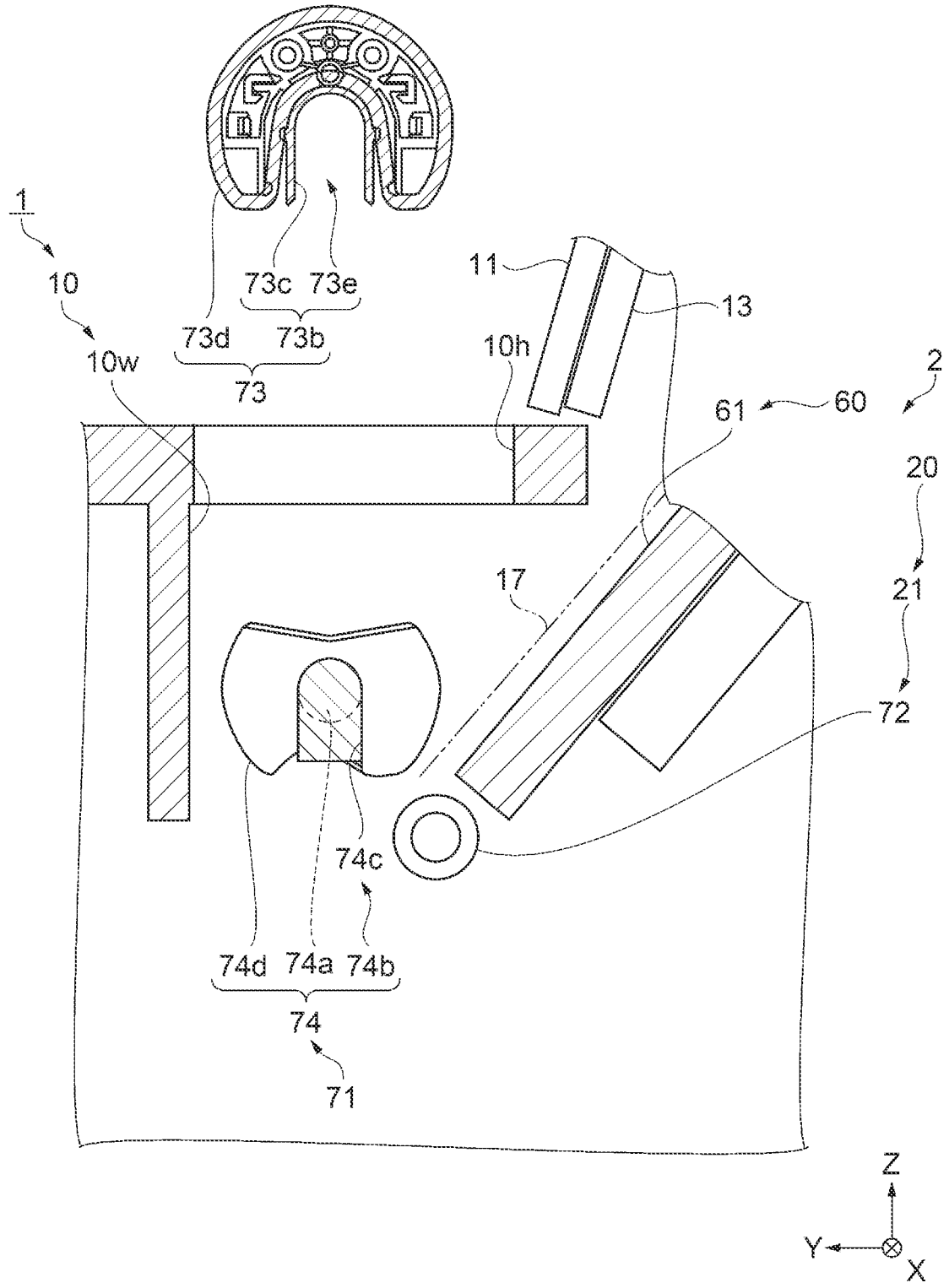
FIG. 8 is a schematic cross-sectional view illustrating a state where the feeding unit is detached from the rotating shaft.

The feeding unit 73 is provided in the housing 10 in such a way as to be turnable to a home position and to a replacement position that enables detachment from the rotating shaft 74. The home position of the feeding unit 73 is a stand-by position of the feeding unit 73 illustrated in FIG. 9, which is an example of a feeding position where it is possible to transport the sheet S mounted on the sheet feeder tray 60. The replacement position of the feeding unit 73 illustrated in FIGS. 5 to 7 is a position where it is possible to attach and detach the feeding unit 73 to and from the rotating shaft 74. Here, the feeding unit 73 is detachable from the rotating shaft 74 as illustrated in FIG. 8.

Figure 9:
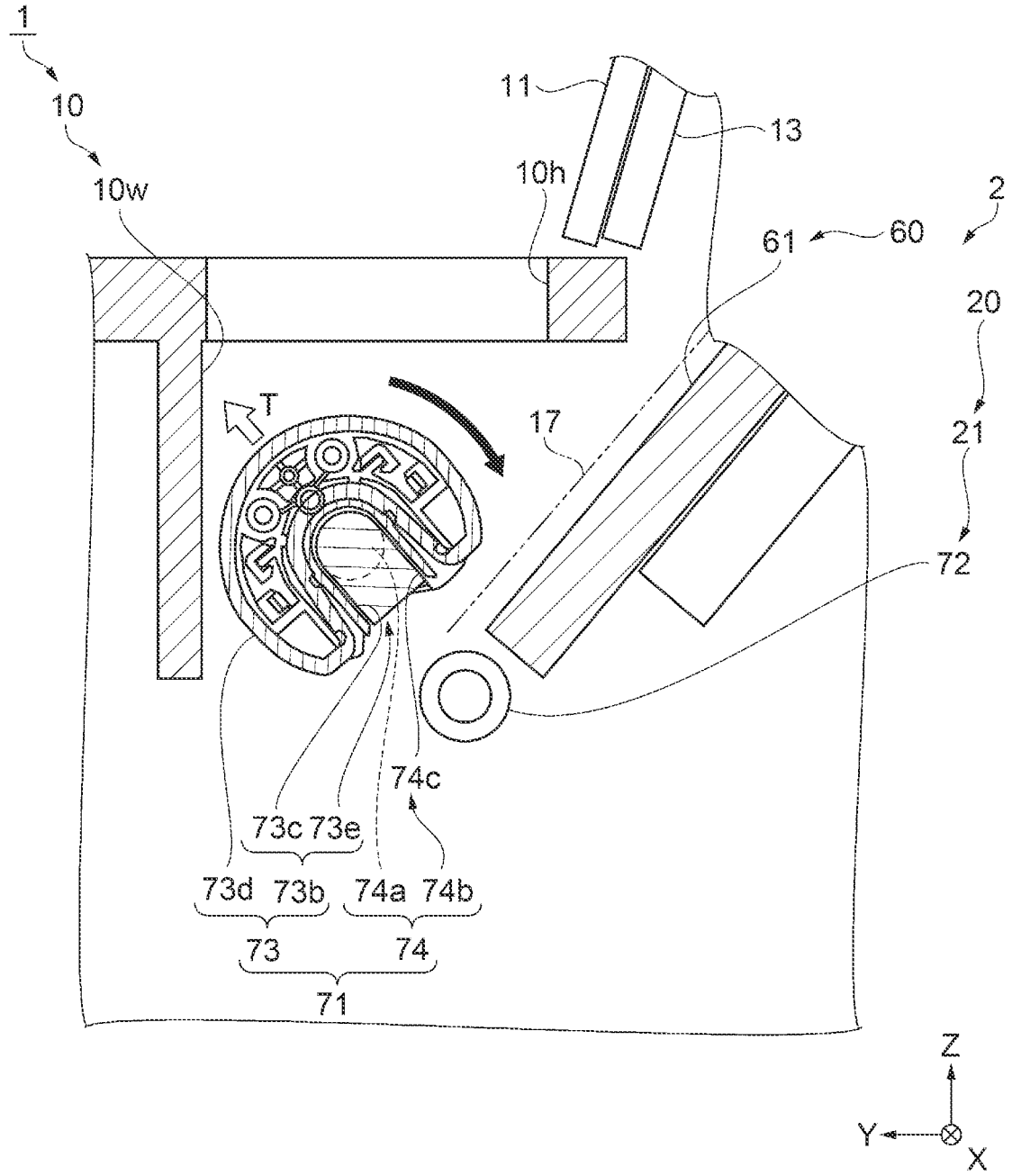
FIG. 9 is a schematic cross-sectional view illustrating the feeding unit located at a home position and the rotating shaft.

When the feeding unit 73 is located at the replacement position as illustrated in FIGS. 5 to 7, a detachment direction T in which the feeding unit 73 is detached from the rotating shaft 74 is oriented to the opening 10*h* located on the +z direction side. When the feeding unit 73 is located at the home position as illustrated in FIG. 9, the detachment direction T is oriented to an inner side surface 10*w* of the housing 10. The inner side surface 10*w* is an example of a region of the housing 10 which is different from the opening 10*h*.

As illustrated in FIG. 5, the feeding unit 73 includes a feed roller portion 73*a*, an operating portion 73*f*, and a spring 73*s*. The operating portion 73*f* is provided on the −x direction side of the feed roller portion 73*a*. The operating portion 73*f* is provided in such a way as to be movable in the x-axis direction relative to the feed roller portion 73*a*. The movement of the operating portion 73*f* in the x-axis direction relative to the feed roller portion 73*a* makes the feeding unit 73 attachable to and detachable from the rotating shaft 74.

The operating portion 73*f* includes a pair of projections 73*h* and 73*k* that project in the −x direction, and a pressurizing portion 73*g* that the user can press in the +x direction as indicated with an open arrow. The spring 73*s* is provided at a position between the feed roller portion 73*a* and the operating portion 73*f* in the x-axis direction. The spring 73*s* biases the operating portion 73*f* in such a direction to move away from the feed roller portion 73*a* in the −x direction.

The feed roller portion 73*a* illustrated in FIG. 5 has a shape formed by cutting a segment away from part of a circle when viewed in the direction in the x-axis direction as illustrated in FIGS. 7 and 8. Thus, the feed roller portion 73*a* is provided with an arc-shaped surface 73*d* that comes into contact with the sheet S, and a flat surface portion formed by cutting part of the circle away. The feeding unit 73 is also provided with an engaged portion 73*b*. The engaged portion 73*b* includes a detachment port 73*e* that is open to the flat surface portion of the feed roller portion 73*a*, and a regulated surface 73*c*.

As illustrated in FIG. 5, the rotating shaft 74 includes a spindle 74*a* and holding portions 74*d* and 74*e*. The spindle 74*a* is provided such that its axial center extends along the x axis. The feeding unit 73 is rotated around the axial center of the spindle 74*a*. The holding portions 74*d* and 74*e* each in a plate shape are disposed in such a way as to provide an interval in the x-axis direction so as to be able to hold the feeding unit 73 between the holding portions 74*d* and 74*e*. The holding portions 74*d* and 74*e* define a position in the x-axis direction of the feeding unit 73. As illustrated in FIGS. 7 to 9, an engaging portion 74*b* to come into engagement with the engaged portion 73*b* of the feeding unit 73 is provided between the holding portions 74*d* and 74*e*. The engaging portion 74*b* includes a regulating surface 74*c*. Meanwhile, the holding portion 74*e* is provided with a pair of through holes 74*h* and 74*k* as illustrated in FIG. 6. The spindle 74*a* has a circular external shape when viewed in a direction along the x-axis direction.

In a state where the feeding unit 73 is attached to the rotating shaft 74 and is capable of transporting the sheet S, the regulated surface 73*c* of the engaged portion 73*b* is regulated by the regulating surface 74*c* of the engaging portion 74*b*, whereby the feeding unit 73 is positioned relative to the rotating shaft 74. In this instance, the projections 73*h* and 73*k* of the operating portion 73*f* are inserted into the through holes 74*h* and 74*k* of the holding portion 74*e*. Accordingly, movement of the feeding unit 73 in the detachment direction T is regulated.

When the user replaces the feeding unit 73, the feeding unit 73 is made accessible through the opening 10*h* by setting the opening-closing member 11 to the open state as illustrated in FIG. 6. Then, in the state where the feeding unit 73 is located at the replacement position, the pressurizing portion 73*g* of the operating portion 73*f* is pressed in the direction of the open arrow as illustrated in FIG. 5, thereby releasing the regulation of movement of the projections 73*h* and 73*k* by the through holes 74*h* and 74*k* of the holding portion 74*e*. Then, as illustrated in FIGS. 7 and 8, the user moves the feeding unit 73 in the detachment direction T being the +z direction relative to the rotating shaft 74, thus detaching the feeding unit 73 from the rotating shaft 74.

After the feeding unit 73 is taken out of the printing apparatus 1 through the opening 10*h*, the user inserts a new feeding unit 73 in the −z direction, which is a direction opposite to the detachment direction T, through the opening 10*h*. Then, the feeding unit 73 is positioned relative to the rotating shaft 74 as a consequence of inserting feeding unit 73 to such a position where the regulated surface 73*c* of the engaged portion 73*b* is regulated by the regulating surface 74*c* of the engaging portion 74*b*. In the meantime, the projections 73*h* and 73*k* of the operating portion 73*f* are inserted into the through holes 74*h* and 74*k* of the holding portion 74*e*, whereby the movement of the feeding unit 73 in the detachment direction T is regulated. In this way, the new feeding unit 73 is fixed to the rotating shaft 74, and the replacement of the feeding unit is completed.

As illustrated in FIG. 3, the printing unit 30 includes a print head 31 that ejects an ink, which is an example of a liquid, toward the sheet S, and a carriage 32 which mounts the print head 31 and is movable in the x direction intersecting with the direction of transportation. A medium support member 34 is disposed below the print head 31 while interposing the transportation route 17 in between.

As illustrated in FIG. 1, the printing apparatus 1 also includes a liquid container unit 33 that supplies the ink to the print head 31. The liquid container unit 33 is a container that can contain the ink. The liquid container unit 33 is coupled to the print head 31 by using a flexible tube (not illustrated). The ink in the liquid container unit 33 is supplied to the print head 31 through the tube.

As illustrated in FIG. 3, the printing unit 30 ejects the ink based on print data onto the sheet S supported by the medium support member 34. In this way, an image based on the print data is printed on the sheet S. The print data is data for causing the printing apparatus 1 to execute the print processing, which is created based on graphic data such as text data and image data to be printed on the sheet S. The sheet S subjected to the print processing is transported by the transportation unit 20 and is sent to the discharge unit 40 that is provided downstream in the direction of transportation of the print head 31.

The discharge unit 40 includes discharge roller pairs 41 that discharge the sheet S subjected to the print processing by the printing unit 30, and a discharge port 42 to which the sheet S is discharged. The discharge roller pairs 41 are arranged in the x direction and respective rollers in the discharge roller pairs 41 are coupled to a common shaft that extends in the x direction.

The discharge roller pairs 41 are provided downstream in the direction of transportation of the printing unit 30. Meanwhile, the discharge port 42 is provided above the sheet discharge stacker 50. The discharge roller pairs 41 transport the sheet S in the direction of transportation, and discharge the sheet S from the discharge port 42 toward the sheet discharge stacker 50 that is drawn out in the +y direction. The sheet S discharged from the discharge port 42 is stacked on the sheet discharge stacker 50. The sheet discharge stacker 50 can be housed in a stacker housing unit 58 provided below the printing unit 30.

As illustrated in FIG. 2, the sheet discharge stacker 50 is configured to be expandable and contractible in the y-axis direction. When the print processing is not carried out, the sheet discharge stacker 50 is housed in the stacker housing unit 58 inside the housing 10. On the other hand, when the print processing is carried out, the housed sheet discharge stacker 50 is used after being drawn out in the +y direction from the stacker housing unit 58.

The sheet discharge stacker 50 includes a first stacker 50*a*, a second stacker 50*b*, and a third stacker 50*c*. The first stacker 50*a* is attached to the housing 10. The third stacker 50*c* can be housed in the second stacker 50*b*, and the second stacker 50*b* can be housed in the first stacker 50*a*. A stacking area of the sheet discharge stacker 50 is enlarged by stretching the second stacker 50*b* and the third stacker 50*c*, so that the sheet discharge stacker 50 can support the sheet S having a relatively large size such as A3 size in a stable condition.

Figure 4:
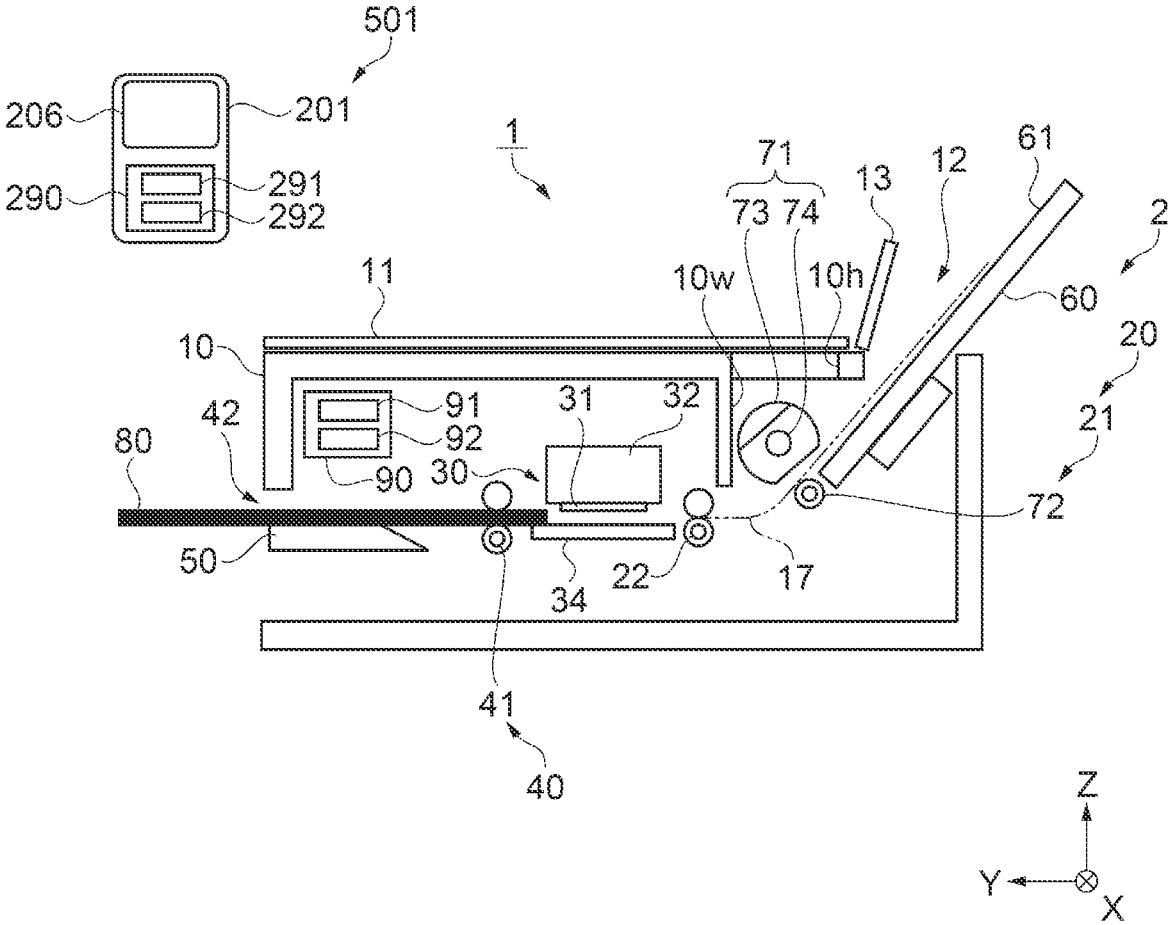
FIG. 4 is a schematic cross-sectional view illustrating the printing apparatus.

Protrusions 56 that extend in the y-axis direction and protrude in the +z direction are formed at two ends in the x-axis direction of an upper part of the first stacker 50*a*. When a printing material mounted on the tray 80 is subjected to the print processing, the tray 80 is inserted from the discharge port 42 into the housing 10 as illustrated in FIG. 4. In other words, the discharge port 42 is an example of an insertion slot for inserting the tray 80. When the tray 80 is inserted from the discharge port 42, side surfaces of the tray 80 come into contact with inner walls of the protrusions 56 of the sheet discharge stacker 50 so as to regulate movement in the x-axis direction of the tray 80. Thus, the tray 80 is inserted in the −y direction toward the inside of the housing 10.

The inserted tray 80 is transported by the discharge roller pairs 41 to a print position where the printing unit 30 can print on the sheet S. The printing unit 30 performs printing on the printing material on the tray 80. After this processing is completed, the tray 80 is discharged from the discharge port 42 by the discharge roller pairs 41. As the printing material, a card C having dimensions of 86.60 mm×53.98 mm×0.76 mm as defined in International Standard ISO/IEC 7810, or a disc D having a diameter of 120 mm and a thickness of 1.2 mm can be mounted on the tray 80 of the present embodiment.

As illustrated in FIG. 3, the control unit 90 is provided in the housing 10. The control unit 90 may be provided in the feeding device 2 instead. The control unit 90 includes a central processing unit (CPU) 91 and a memory 92. The CPU 91 can execute various programs stored in the memory 92. For example, the CPU 91 can conduct various determinations, various commands, and the like. For example, the memory 92 stores various programs such as a program for transporting the sheet S, various programs concerning display methods for displaying a status of the feeding device 2, various tables, various counter values, and the like.

The control unit 90 controls the feeding device 2. The control unit 90 also controls the entire printing apparatus 1. For example, the control unit 90 transports the sheet S toward the printing unit 30 in the direction of transportation by controlling the feed roller pair 21 and the transportation roller pair 22 provided to the feeding device 2.

Meanwhile, when performing the printing on the sheet S, for example, the control unit 90 controls the printing unit 30 so as to perform the printing by ejecting the ink onto the sheet S that is transported to the feeding device 2. On the other hand, for example, the control unit 90 controls the discharge roller pairs 41, thereby transporting the sheet S printed by the printing unit 30 in the direction of transportation.

The control unit 90 may be coupled to a control unit 290 of the external device 201 through a not-illustrated communication interface provided to the printing apparatus 1, any of a communication cable and a wireless communication line, and so forth. The external device 201 may include a display unit 206 and the control unit 290 that includes a CPU 291 and a memory 292 as with the control unit 90. Examples of the external device 201 include a personal computer, a smartphone, a mobile phone, a personal digital assistant, and the like. The control unit 290 is regarded as an external control unit provided to the external device 201. The control unit 290 may be a program stored in the external device 201 instead.

The control unit 90 performs annunciation processing to transmit data and a signal for requesting display of information based on the data to at least one of the display unit 6 and the control unit 290 of the external device 201, thereby conducting annunciation while displaying the information based on the data on the display unit 6 or the display unit 206. In this case, the printing apparatus 1 and the external device 201 may be regarded as constituting a system 501. When the control unit 90 controls the printing apparatus 1, the system 501 is an example of a printing system. When the control unit 90 controls the feeding device 2, the system 501 is an example of a feeding system.

When either the printing apparatus 1 or the feeding device 2 constitutes the system 501 in cooperation with the external device 201, the CPU 291 of the control unit 290 may execute various programs stored in any of the memory 292 and the memory 92 of the control unit 90 and conduct various determinations, various commands, and the like concerning the printing apparatus 1 or the feeding device 2. For example, the memory 292 may store various programs such as a program for transporting the sheet S and a program concerning a display method for displaying a status of the feeding device 2, various tables, various counter values, and the like. In this case, the printing apparatus 1 and the external device 201 may be regarded as constituting the system 501. When the control unit 290 controls the printing apparatus 1, the system 501 is an example of the printing system. When the control unit 290 controls the feeding device 2, the system 501 is an example of the feeding system.

Next, a flow of processing when the control unit 90 determines a state of use of the feeding unit 73 based on the number of the sheets S transported by the feeding unit 73 in the present embodiment will be described with reference to a flowchart illustrated in FIG. 10. In the present embodiment, the flow of processing when the control unit 90 determines the state of use of the feeding unit 73 based on the number of the sheets S transported by the feeding unit 73 corresponds to a method of controlling the feeding device.

In the present embodiment, the control unit 90 obtains a feed counter value N based on the number of the sheets S transported by the feeding unit 73 and life information LJ concerning a life of the feeding unit 73 from the memory 92, for example. The life information LJ includes a first threshold Nn and a second threshold Ne. Each of the first threshold Nn and the second threshold Ne are thresholds which represents an indication for replacement of the feeding unit 73. Each of first threshold Nn and the second threshold Ne is the transported number of the sheets S transported by the feeding unit 73. The second threshold Ne is a larger value than the first threshold Nn.

Figure 10:
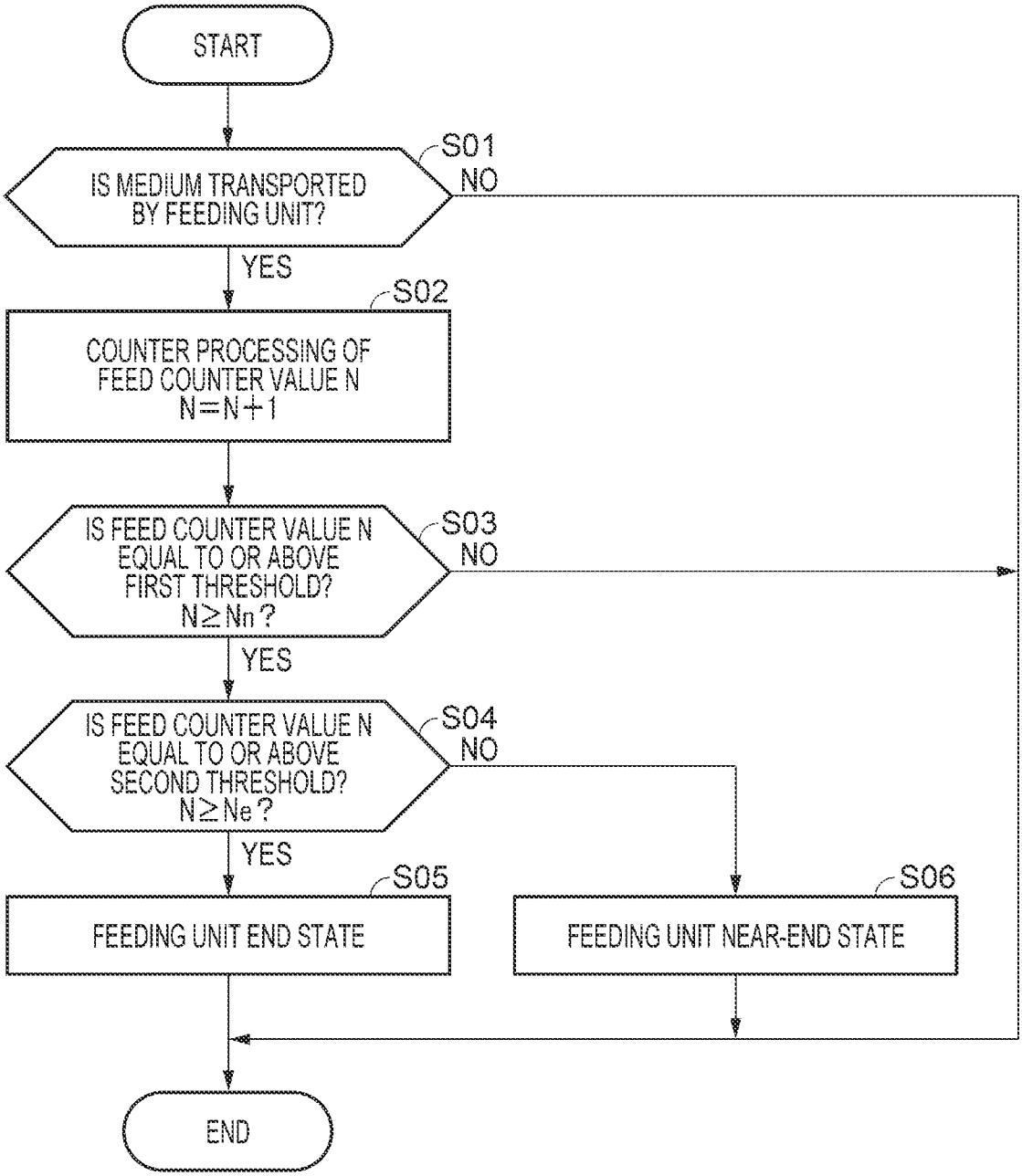
FIG. 10 is a flowchart illustrating a flow of processing when determining a state of use of the feeding unit.

In step S01 of the flowchart illustrated in FIG. 10, the control unit 90 checks whether or not the sheet S is transported by the feeding unit 73. When the sheet S is transported by the feeding unit 73, step S01 turns out to be yes and the control unit 90 moves the processing to step S12. When the sheet S is not transported by the feeding unit 73, step S01 turns out to be no and the control unit 90 terminates the processing.

The determination as to whether or not the sheet S is transported by the feeding unit 73 is made based on a result of detection with a sheet detection sensor (not illustrated), which is provided at a position downstream in the direction of transportation of the feed roller pair 21 on the transportation route 17. For example, the control unit 90 determines that the sheet S is transported when the feeding unit 73 is driven and the sheet detection sensor detects passage of the sheet S. On the other hand, the control unit 90 determines that the sheet S is not transported when the feeding unit 73 is driven and the sheet detection sensor does not detect the passage of the sheet S, for example. In this case, the control unit 90 determines that the sheet S is misfed.

In step S02, the control unit 90 carries out counter processing of the feed counter value N, and N=N+1 holds true as a consequence. The control unit 90 stores the feed counter value N that undergoes the counter processing to the memory 92. After carrying out the processing in step S02, the control unit 90 moves the processing to step S03.

In step S03, the control unit 90 checks whether or not the feed counter value N is equal to or above the first threshold Nn. When the feed counter value N is equal to or above the first threshold Nn, step S03 turns out to be yes and the control unit 90 moves the processing to step S04. When the feed counter value N is smaller than the first threshold Nn, step S03 turns out to be no and the control unit 90 terminates the processing.

In step S04, the control unit 90 checks whether or not the feed counter value N is equal to or above the second threshold Ne. When the feed counter value N is equal to or above the second threshold Ne, step S04 turns out to be yes and the control unit 90 moves the processing to step S05. When the feed counter value N is smaller than the second threshold Ne, step S04 turns out to be no and the control unit 90 moves the processing to step S06.

In step S05, the control unit 90 determines that the state of use of the feeding unit 73 is a feeding unit end state where it is necessary to replace the feeding unit 73. After carrying out the processing in step S05, the control unit 90 terminates the processing when determining the state of use of the feeding unit 73.

In step S06, the control unit 90 determines that the state of use of the feeding unit 73 is a feeding unit near-end state where it is desirable to replace the feeding unit 73. After carrying out the processing in step S06, the control unit 90 terminates the processing when determining the state of use of the feeding unit 73.

Next, a flow of processing to be carried out when the control unit 90 determines in step S06 of the flowchart illustrated in FIG. 10 that the state of use of the feeding unit 73 is the feeding unit near-end state will be described with reference to a flowchart illustrated in FIG. 11. In the present embodiment, the flow of the processing to be carried out when the control unit 90 determines that the state of use of the feeding unit 73 is the feeding unit near-end state corresponds to the method of controlling the feeding device.

Figure 11:
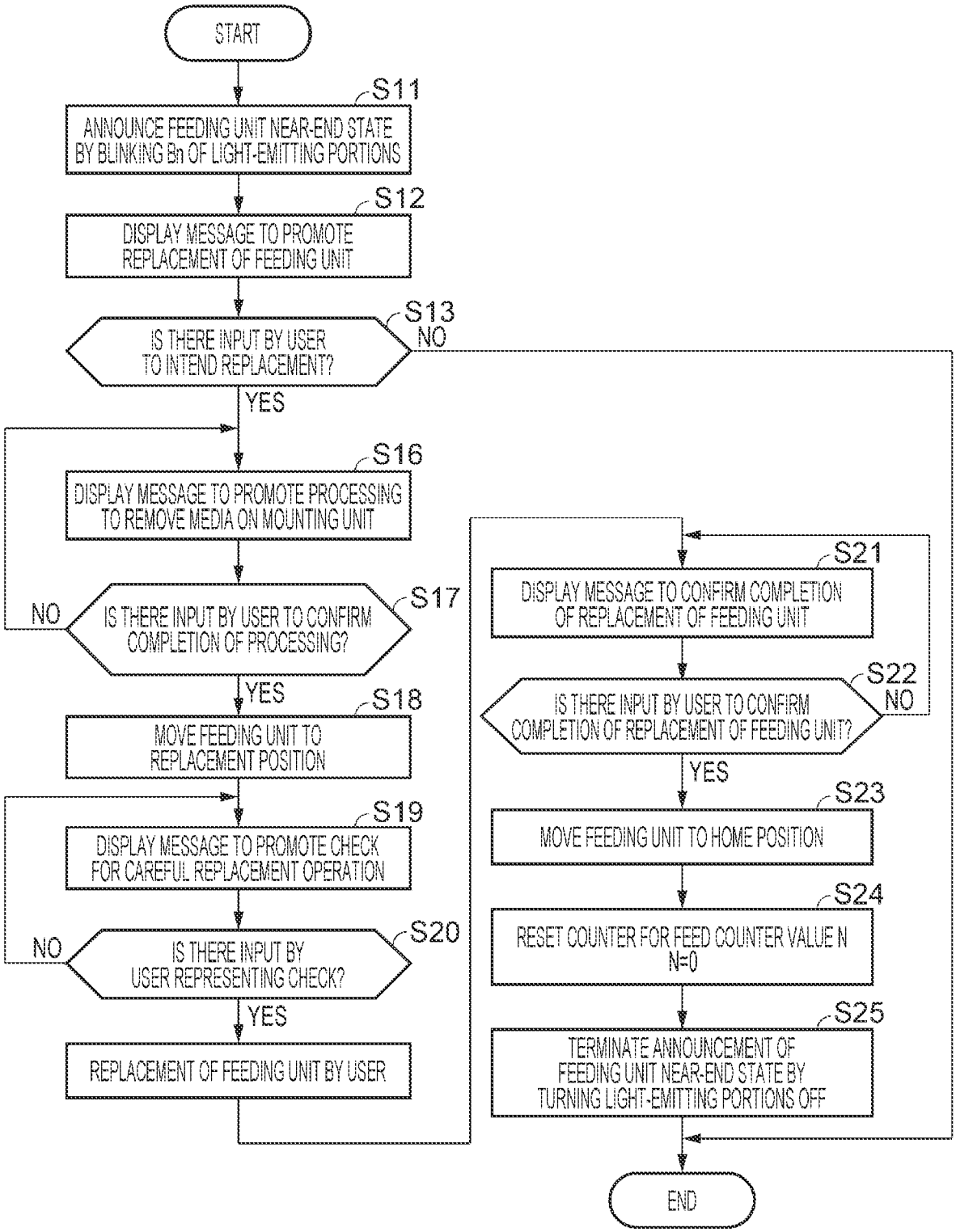
FIG. 11 is a flowchart illustrating a flow of processing to be carried out when the state of use of the feeding unit is determined as a near-end state of the feeding unit.

When the state of use of the feeding unit 73 is determined to be the feeding unit near-end state in step S06 of the flowchart illustrated in FIG. 10, the control unit 90 announces that the feeding unit 73 is in the near-end state in step S11 of the flowchart illustrated in FIG. 11. To be more precise, the control unit 90 carries out annunciation to the user by blinking Bn of the light-emitting portions 5*a*, 5*b*, and 5*c*.

In the blinking Bn of the light-emitting portions 5*a*, 5*b*, and 5*c* in the present embodiment, the control unit 90 blinks the light-emitting portions 5*a* and 5*c* out of the light-emitting portions 5*a*, 5*b*, and 5*c* alternately at an interval of one second each. After carrying out the processing in step S11, the control unit 90 moves the processing to step S12.

Figure 13:
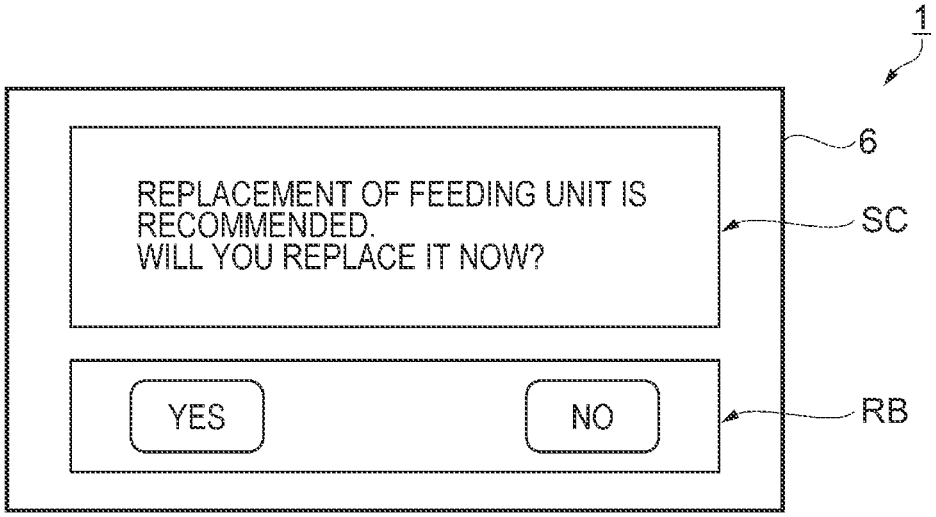
FIG. 13 is a schematic diagram illustrating a display unit displaying a setting screen.

In step S12, the control unit 90 displays a message for promoting replacement of the feeding unit 73. For example, the control unit 90 causes the display unit 6 to display a setting screen SC as illustrated in FIG. 13, for example. In this case, considering an occasion in which the user does not desire the replacement of the feeding unit 73 at this timing, a message for confirming an intention to replace the feeding unit 73 at this timing is displayed on the setting screen SC in addition to the message to promote the replacement of the feeding unit 73. The setting screen SC is an example of such a message.

In the present embodiment, the display unit 6 has the touch panel function, and the radio button units RB illustrated in FIG. 13 and in FIGS. 14 to 17 to be described later are displayed on the display unit 6. When the control unit 90 is coupled to the external device 201, the setting screens SC and the radio button units RB illustrated in FIGS. 13 to 17 may be displayed on the display unit 206 of the external device 201. After carrying out the processing in step S12, the control unit 90 moves the processing to step S13.

In step S13, the control unit 90 checks whether or not there is input by the user to intend the replacement of the feeding unit 73. To be more precise, when the user selects "yes" in the radio button unit RB illustrated in FIG. 13, the control unit 90 determines that there is the input by the user to intend the replacement of the feeding unit 73 through the radio button unit RB, and that the instruction to replace the feeding unit 73 is accepted. In this case, step S13 turns out to be yes and the control unit 90 moves the processing to step S16. When the user selects "no" in the radio button unit RB illustrated in FIG. 13, step S13 turns out to be no and the control unit 90 terminates the processing.

Figure 14:
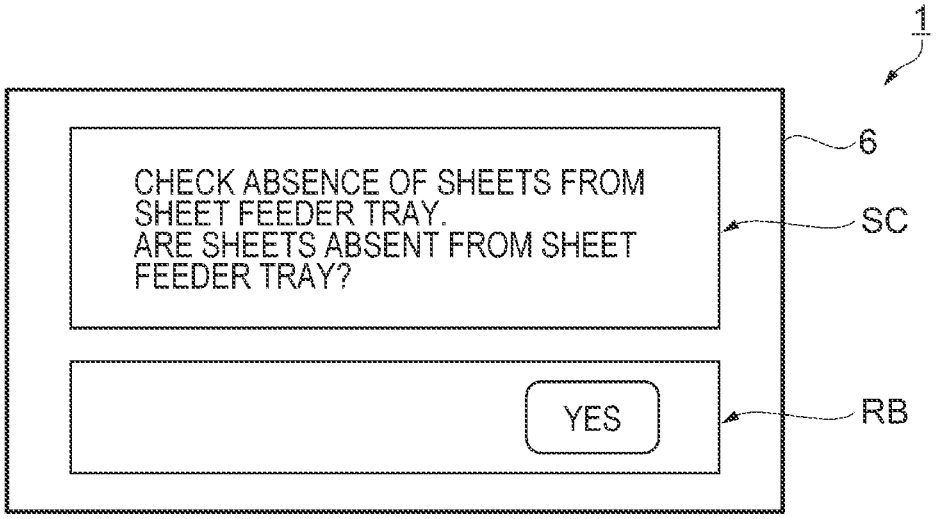
FIG. 14 is a schematic diagram illustrating the display unit displaying another setting screen.

In step S16, the control unit 90 displays a message to promote processing to remove the sheets S on the sheet feeder tray 60. For example, the control unit 90 causes the display unit 6 to display the setting screen SC as illustrated in FIG. 14. In this case, a message for confirming the state of the sheet feeder tray 60 without the sheets S as a consequence of processing by the user is displayed on the setting screen SC in addition to the message to promote the check of absence of the sheets S from the sheet feeder tray 60. In this way, the control unit 90 urges the user to perform the processing to remove the sheets S on the sheet feeder tray 60 when there are the sheets S on the sheet feeder tray 60. After carrying out the processing in step S16, the control unit 90 moves the processing to step S17.

In step S17, the control unit 90 checks whether or not there is input by the user to confirm completion of the processing. To be more precise, when the user selects "yes" in the radio button unit RB illustrated in FIG. 14, the control unit 90 determines that there is the input by the user to confirm completion of the processing to remove the sheets S on the sheet feeder tray 60 through the radio button unit RB, and that there are no sheets S on the sheet feeder tray 60. In this case, the step S17 turns out to be yes and the control unit 90 moves the processing to step S18. When the user does not select "yes" in the radio button unit RB illustrated in FIG. 14, the control unit 90 moves the processing to step S16 and continues the processing in step S16.

In step S18, the control unit 90 moves the feeding unit 73 to the replacement position. For example, when the feeding unit 73 is located at the home position as illustrated in FIG. 9, the control unit 90 controls the drive of the feed motor, thereby rotating the rotating shaft 74 in a direction of a solid arrow being a clockwise direction when viewing the feeding unit 73 in the +x direction from the −x direction side. Thus, the control unit 90 moves the feeding unit 73 to the replacement position illustrated in FIG. 7. In other words, the control unit 90 changes the position of the feeding unit 73 to the replacement position after accepting the instruction to replace the feeding unit 73 from the instruction acceptance unit IP. After carrying out the processing in step S18, the control unit 90 moves the processing to step S19.

Figure 15:
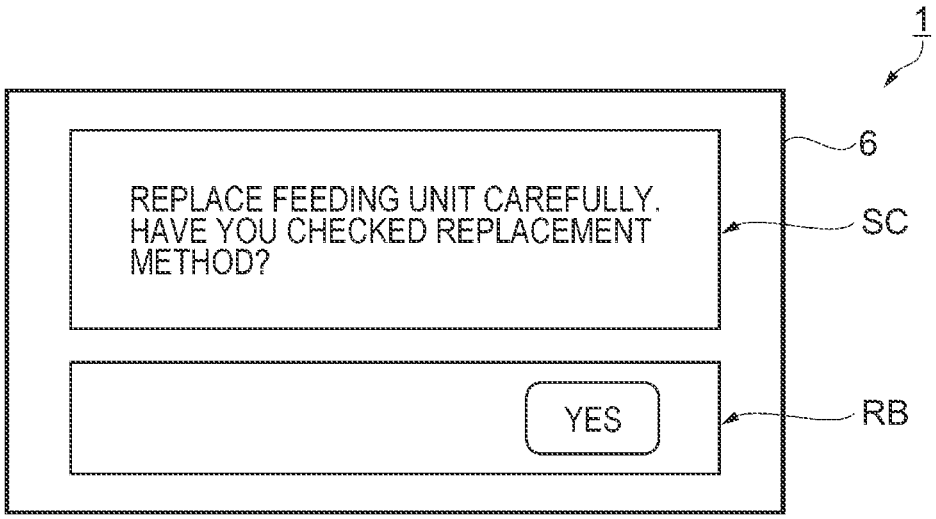
FIG. 15 is a schematic diagram illustrating the display unit displaying another setting screen.

In step S19, the control unit 90 displays a message to promote confirmation of a careful replacement operation. For example, the control unit 90 causes the display unit 6 to display the setting screen SC as illustrated in FIG. 15 so as to urge the user to replace the feeding unit 73 after confirming a replacement method. After carrying out the processing in step S19, the control unit 90 moves the processing to step S20.

In step S20, the control unit 90 checks whether or not there is input representing the confirmation by the user. To be more precise, when the user selects "yes" in the radio button unit RB illustrated in FIG. 15, the control unit 90 determines that there is the input, from the radio button unit RB, by the user to confirm that the user is going to conduct the careful replacement operation. In this case, the step S20 turns out to be yes and the control unit 90 moves the processing to step S21. When the user does not select "yes" in the radio button unit RB illustrated in FIG. 15, the control unit 90 moves the processing to step S19 and continues the processing in step S19.

Figure 16:
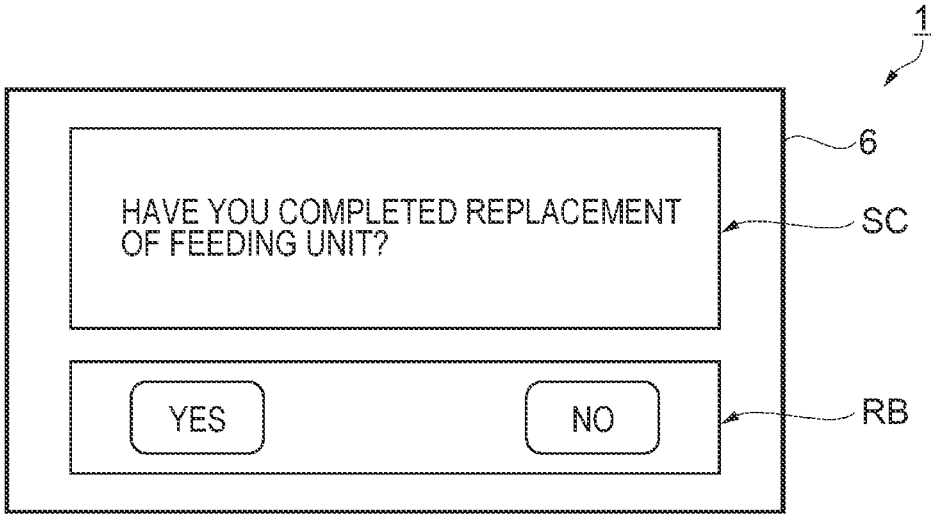
FIG. 16 is a schematic diagram illustrating the display unit displaying another setting screen.

While the user is replacing the feeding unit 73 in accordance with the above-mentioned procedures after confirming the careful replacement operation, the control unit 90 displays a message in step S21 to confirm whether or not the replacement of the feeding unit 73 is completed. For example, the control unit 90 causes the display unit 6 to display the setting screen SC as illustrated in FIG. 16. After carrying out the processing in step S21, the control unit 90 moves the processing to step S22.

In step S22, the control unit 90 checks whether or not there is input by the user to confirm completion of replacement of the feeding unit 73. To be more precise, when the user selects "yes" in the radio button unit RB illustrated in FIG. 16, the control unit 90 determines that there is the input by the user to confirm completion of the replacement of the feeding unit 73 through the radio button unit RB, and that the replacement of the feeding unit 73 is completed. In this case, the step S22 turns out to be yes and the control unit 90 moves the processing to step S23. When the user selects "no" in the radio button unit RB illustrated in FIG. 16 or when the user does not select any of them, the control unit 90 moves the processing to step S21 and continues the processing in step S21.

In step S23, the control unit 90 moves the feeding unit 73 to the home position. For example, the replacement of the feeding unit 73 by the user is assumed to have been completed and the replaced feeding unit 73 is assumed to be located at the replacement position as illustrated in FIG. 6. In this case, the control unit 90 controls the drive of the feed motor, thereby rotating the rotating shaft 74 in the clockwise direction when viewing the feeding unit 73 in the +x direction from the −x direction side. Thus, the control unit 90 moves the replaced feeding unit 73 to the home position illustrated in FIG. 9. After carrying out the processing in step S23, the control unit 90 moves the processing to step S24.

In step S24, the control unit 90 resets the counter for the feed counter value N, and N=0 holds true as a consequence. The control unit 90 stores the feed counter value N subjected to the counter processing into the memory 92. After carrying out the processing in step S24, the control unit 90 moves the processing to step S25.

In step S25, the control unit 90 terminates the annunciation of the near-end state of the feeding unit 73 by the blinking Bn of the light-emitting portions 5*a*, 5*b*, and 5*c*. Accordingly, the light-emitting portions 5*a*, 5*b*, and 5*c* are turned off. After carrying out the processing in step S25, the control unit 90 terminates the processing to be carried out when the control unit 90 determines that the state of use of the feeding unit 73 is the feeding unit near-end state.

Next, a flow of processing to be carried out when the control unit 90 determines in step S05 of the flowchart illustrated in FIG. 10 that the state of use of the feeding unit 73 is the feeding unit end state will be described with reference to a flowchart illustrated in FIG. 12. In the present embodiment, the flow of the processing to be carried out when the control unit 90 determines that the state of use of the feeding unit 73 is the feeding unit end state corresponds to the method of controlling the feeding device. Here, the processing in step S12 and in steps S16 to S24 of the flowchart illustrated in FIG. 12 is the same as the processing in step S12 and in steps S16 to S24 of the flowchart illustrated in FIG. 11, and detailed explanations thereof will be omitted.

Figure 12:
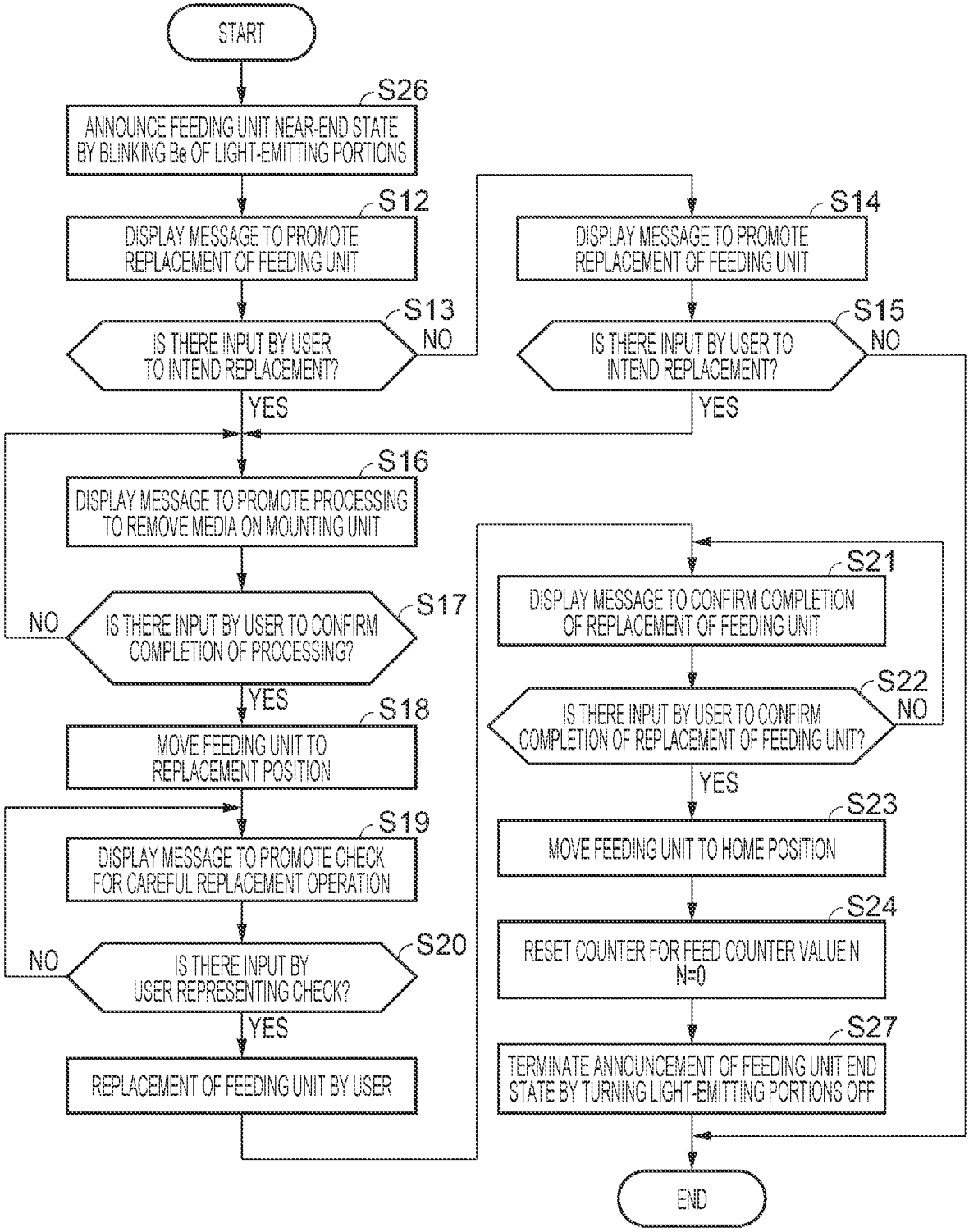
FIG. 12 is a flowchart illustrating a flow of processing to be carried out when the state of use of the feeding unit is determined as an end state of the feeding unit.

When the state of use of the feeding unit 73 is determined to be the feeding unit end state in step S05 of the flowchart illustrated in FIG. 10, the control unit 90 announces that the feeding unit 73 is in the end state in step S26 of the flowchart illustrated in FIG. 12. To be more precise, the control unit 90 carries out annunciation to the user by blinking Be of the light-emitting portions 5*a*, 5*b*, and 5*c*.

In the blinking Be of the light-emitting portions 5*a*, 5*b*, and 5*c* in the present embodiment, the control unit 90 blinks the light-emitting portions 5*a* and 5*c* out of the light-emitting portions 5*a*, 5*b*, and 5*c* simultaneously at an interval of one second. After carrying out the processing in step S26, the control unit 90 moves the processing to step S12.

In step S12, the control unit 90 moves the processing to step S13 after carrying out the processing in step S12.

In step S13, the control unit 90 checks whether or not there is the input by the user to intend the replacement of the feeding unit 73. To be more precise, when the user selects "yes" in the radio button unit RB illustrated in FIG. 13, the control unit 90 determines that there is the input by the user to intend the replacement of the feeding unit 73 through the radio button unit RB, and that the instruction to replace the feeding unit 73 is accepted. In this case, step S13 turns out to be yes and the control unit 90 moves the processing to step S16. When the user selects "no" in the radio button unit RB illustrated in FIG. 13, step S13 turns out to be no and the control unit 90 moves the processing to step S14.

Figure 17:
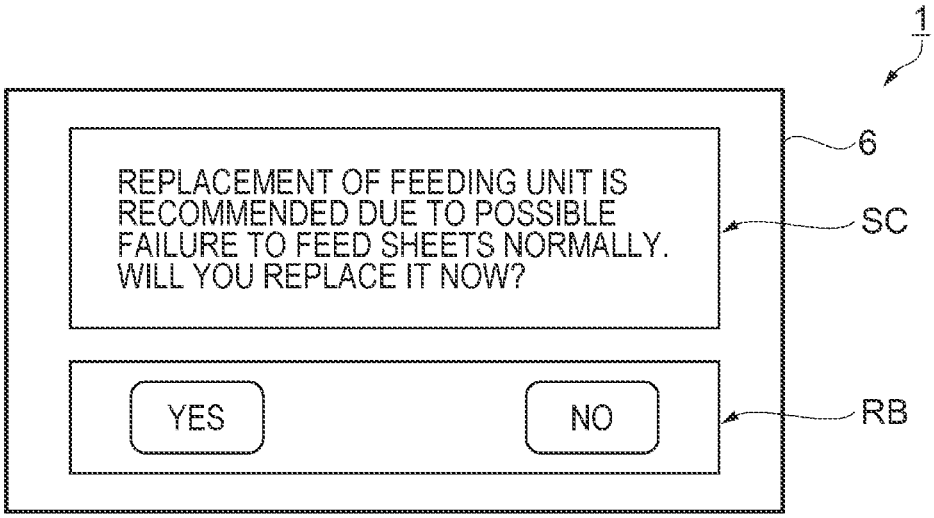
FIG. 17 is a schematic diagram illustrating the display unit displaying another setting screen.

In step S14, the control unit 90 displays a message to promote the replacement of the feeding unit 73. In other words, when the feeding unit 73 is in the end state, that is, when the feed counter value N is equal to or above the second threshold Ne, the control unit 90 displays the message to promote the replacement of the feeding unit 73 more than once. In this instance, the control unit 90 causes the display unit 6 to display the setting screen SC as illustrated in FIG. 17, for example. In this case, considering an occasion in which the user does not desire the replacement of the feeding unit 73 at this timing, the message for confirming the intention as to whether or not the feeding unit 73 is to be replaced at this timing is displayed on the setting screen SC in addition to the message to promote the replacement of the feeding unit 73. After carrying out the processing in step S14, the control unit 90 moves the processing to step S15.

In step S15, the control unit 90 checks whether or not there is the input by the user to intend the replacement of the feeding unit 73. To be more precise, when the user selects "yes" in the radio button unit RB illustrated in FIG. 17, the control unit 90 determines that there is the input by the user to intend the replacement of the feeding unit 73 through the radio button unit RB, and that the instruction to replace the feeding unit 73 is accepted. In this case, step S15 turns out to be yes and the control unit 90 moves the processing to step S16. When the user selects "no" in the radio button unit RB illustrated in FIG. 17, step S15 turns out to be no and the control unit 90 terminates the processing.

In steps S16 to S24, the control unit 90 carries out the same processing as the processing in steps S16 to S24 of the flowchart illustrated in FIG. 11. After carrying out the processing in step S24, the control unit 90 moves the processing to step S27.

In step S27, the control unit 90 terminates the annunciation of the end state of the feeding unit 73 by the blinking Be of the light-emitting portions 5*a*, 5*b*, and 5*c*. Accordingly, the light-emitting portions 5*a*, 5*b*, and 5*c* are turned off. After carrying out the processing in step S27, the control unit 90 terminates the processing to be carried out when the control unit 90 determines that the state of use of the feeding unit 73 is the feeding unit end state.

Next, a flow of processing to be carried out when the printing apparatus 1 does not include the display unit 6 and the control unit 90 determines that the state of use of the feeding unit 73 is the feeding unit near-end state will be described with reference to the flowchart illustrated in FIG. 11. Since it is not possible to display the setting screens SC in the embodiment when the printing apparatus 1 does not include the display unit 6, the control unit 90 does not carry out the processing in steps S12, S16, S17, S19, S20, and S21 of the flowchart illustrated in FIG. 11.

In step S11, the control unit 90 announces that the feeding unit 73 is in the near-end state. To be more precise, the control unit 90 carries out the annunciation to the user by the blinking Bn of the light-emitting portions 5*a*, 5*b*, and 5*c*. In the blinking Bn of the light-emitting portions 5*a*, 5*b*, and 5*c* in the present embodiment, the control unit 90 blinks the light-emitting portions 5*a* and 5*c* out of the light-emitting portions 5*a*, 5*b*, and 5*c* alternately at the interval of one second each. After carrying out the processing in step S11, the control unit 90 moves the processing to step S13.

In step S13, the control unit 90 checks whether or not there is the input by the user to intend the replacement of the feeding unit 73. When the user intends to replace the feeding unit 73 by confirming the annunciation of the feeding unit near-end state by the blinking Bn of the light-emitting portions 5*a*, 5*b*, and 5*c*, the user inputs the intention to replace the feeding unit 73 by using the operating buttons 4*a*, 4*b*, and 4*c* of the operating panel 4 in the present embodiment.

Specifically, the user presses the two operating buttons 4*b* and 4*c* simultaneously for 5 seconds or more. Accordingly, the control unit 90 determines that there is the input by the user to intend the replacement of the feeding unit 73, and that the instruction to replace the feeding unit 73 is accepted. In other words, the control unit 90 determines the instruction to replace the feeding unit 73 when at least two operating buttons out of the operating buttons 4*a*, 4*b*, and 4*c* are pressed simultaneously. In this case, the step S13 turns out to be yes and the control unit 90 moves the processing to step S18. When there is no input by using the above-mentioned operating buttons 4*b* and 4*c* even after a lapse of a predetermined period since the processing in step S11 is carried out, step S13 turns out to be no and the control unit 90 terminates the processing.

In step S18, the control unit 90 moves the feeding unit 73 to the replacement position as described above. After carrying out the processing in step S18, the control unit 90 moves the processing to step S22. When the feeding unit 73 is moved to the replacement position, the user replaces the feeding unit 73 in accordance with the above-mentioned procedures.

In step S22, the control unit 90 checks whether or not there is the input by the user to confirm completion of replacement of the feeding unit 73. In the present embodiment, when the replacement of the feeding unit 73 is completed, the user inputs the completion of replacement of the feeding unit 73 by using the operating buttons 4*a*, 4*b*, and 4*c* of the operating panel 4.

Specifically, the user presses the two operating buttons 4*a* and 4*c* simultaneously for 5 seconds or more. Accordingly, the control unit 90 determines that there is the input by the user to confirm the completion of replacement of the feeding unit 73, and that the replacement of the feeding unit 73 is completed. In other words, the control unit 90 determines that the replacement of the feeding unit 73 is completed when at least two operating buttons out of the operating buttons 4*a*, 4*b*, and 4*c* are pressed simultaneously. In this case, the step S22 turns out to be yes and the control unit 90 moves the processing to step S23. When there is no input by using the above-mentioned operating buttons 4*a* and 4*c*, the control unit 90 continues the processing in step S22.

As with when the printing apparatus 1 includes the display unit 6, the control unit 90 carries out the processing in steps S23, S24, and S25, and then terminates the processing to be carried out when the control unit 90 determines that the state of use of the feeding unit 73 is the feeding unit near-end state.

In a flow of the processing to be carried out when the printing apparatus 1 does not include the display unit 6 and the control unit 90 determines that the state of use of the feeding unit 73 is the feeding unit end state, the control unit 90 does not carry out the processing in steps S12, S14, S15, S16, S17, S19, S20, and S21 of the flowchart illustrated in FIG. 12 since the printing apparatus 1 cannot display the setting screens SC.

As a consequence, the flow of the processing to be carried out when the printing apparatus 1 does not include the display unit 6 and the control unit 90 determines that the state of use of the feeding unit 73 is the feeding unit end state is the same as the flow of the processing to be carried out when the printing apparatus 1 does not include the display unit 6 and the control unit 90 determines that the state of use of the feeding unit 73 is the feeding unit near-end state except that the processing in steps S11 and S25 therein is replaced by the processing in steps S26 and S27 of the flowchart illustrated in FIG. 12. Accordingly, explanations of this flow will be omitted.

Incidentally, a degree of deterioration in transportation performance of the feeding unit 73 may vary depending on the type of the sheets S used by the user, environmental factors, and so forth. in this regard, the timing to determine that the feeding unit 73 is either in the near-end state or in the end state by comparing the feed counter value N with the life information LJ and to display the message to promote the replacement of the feeding unit 73 may not coincide with the timing supposed to replace the feeding unit 73 due to the deterioration in transportation performance thereof. As a consequence, the user may replace the feeding unit 73 that is not deteriorated in transportation performance or the feeding unit 73 that is deteriorated in transportation performance may be continuously used without the replacement.

This is why the printing apparatus 1 or the feeding device 2 of the present embodiment enables the user to set whether or not it is appropriate to announce the state of the feeding unit 73 and to display the message to promote the replacement of the feeding unit 73. When the user switches between the setting not to announce the state of the feeding unit 73 or not to display the message to promote the replacement of the feeding unit 73 and the setting to announce the state of the feeding unit 73 and to display the message to promote the replacement of the feeding unit 73, the user presses the two operating buttons 4*a* and 4*b* simultaneously for 5 seconds or more. Accordingly, the control unit 90 or the control unit 290 of the external device 201 coupled to the control unit 90 to be escribed later determines that there is the request from the user to switch the above-mentioned setting, and switches between the setting not to announce the state of the feeding unit 73 or not to display the message to promote the replacement of the feeding unit 73 and the setting to announce the state of the feeding unit 73 and to display the message to promote the replacement of the feeding unit 73.

Moreover, in the printing apparatus 1 or the feeding device 2 of the present embodiment, the control unit 90 or the control unit 290 can cause the display units 6 and 206 to display information concerning replacement of the feeding unit 73 being the information for allowing the user to determine the timing to replace the feeding unit 73 such as the number of the sheets S transported by the feeding unit 73.

Figure 18:
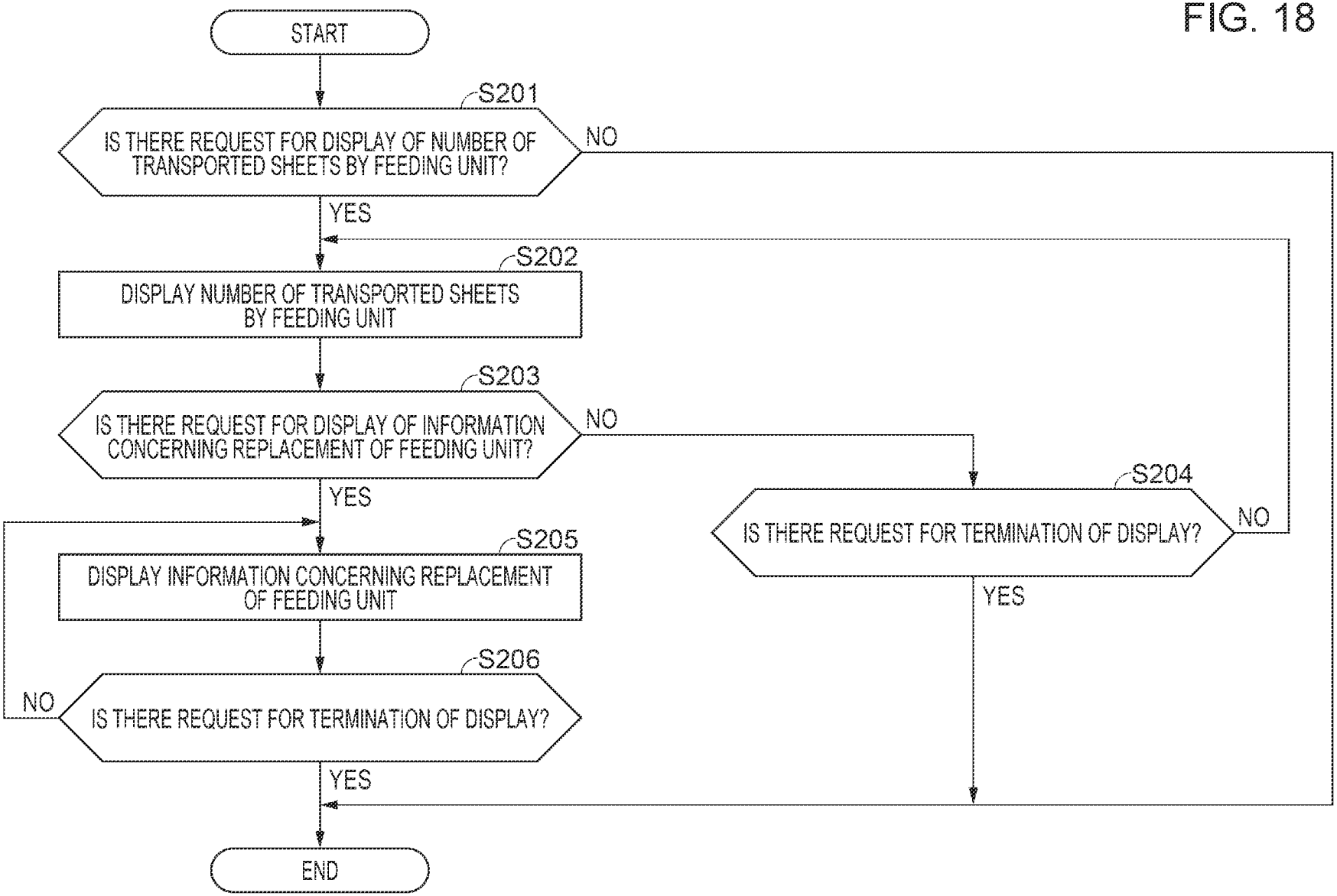
FIG. 18 is a flowchart illustrating a flow of processing when displaying information concerning replacement of the feeding unit.

Next, a flow of processing when displaying the information concerning replacement of the feeding unit 73 in the present embodiment by causing the control unit 290 of the external device 201 coupled to the control unit 90 to execute the program stored in any of the memory 92 and the memory 292 will be described with reference to a flowchart illustrated in FIG. 18. In the present embodiment, the flow of the processing when the control unit 290 displays the information concerning replacement of the feeding unit 73 corresponds to a method of controlling the feeding system.

Meanwhile, processing to be carried out when the control unit 290 of the external device 201 coupled to the control unit 90 displays the information concerning replacement of the feeding unit 73 corresponds to processing to be carried out when the system 501 displays the information concerning replacement of the feeding unit 73. A program to be executed by the control unit 290 when displaying the information concerning replacement of the feeding unit 73 corresponds to a program for causing the control unit 290 to control the feeding device 2 including the replaceable feeding unit 73 that transports the sheet S.

In an initial state, the printing apparatus 1 or the feeding device 2 of the present embodiment is set to withhold annunciation of the near-end state and annunciation of the end state of the feeding unit 73 and to withhold display for promoting the replacement of the feeding unit 73. For this reason, the user checks the number of the sheets S transported by the feeding unit 73 in order to determine the timing to replace the feeding unit 73. In step S201, the control unit 290 checks whether or not there is a request for display of the number of transported sheets by the feeding unit 73. To be more precise, the control unit 290 checks whether or not there is input by the user to request for display of the number of transported sheets by the feeding unit 73.

Figure 19:
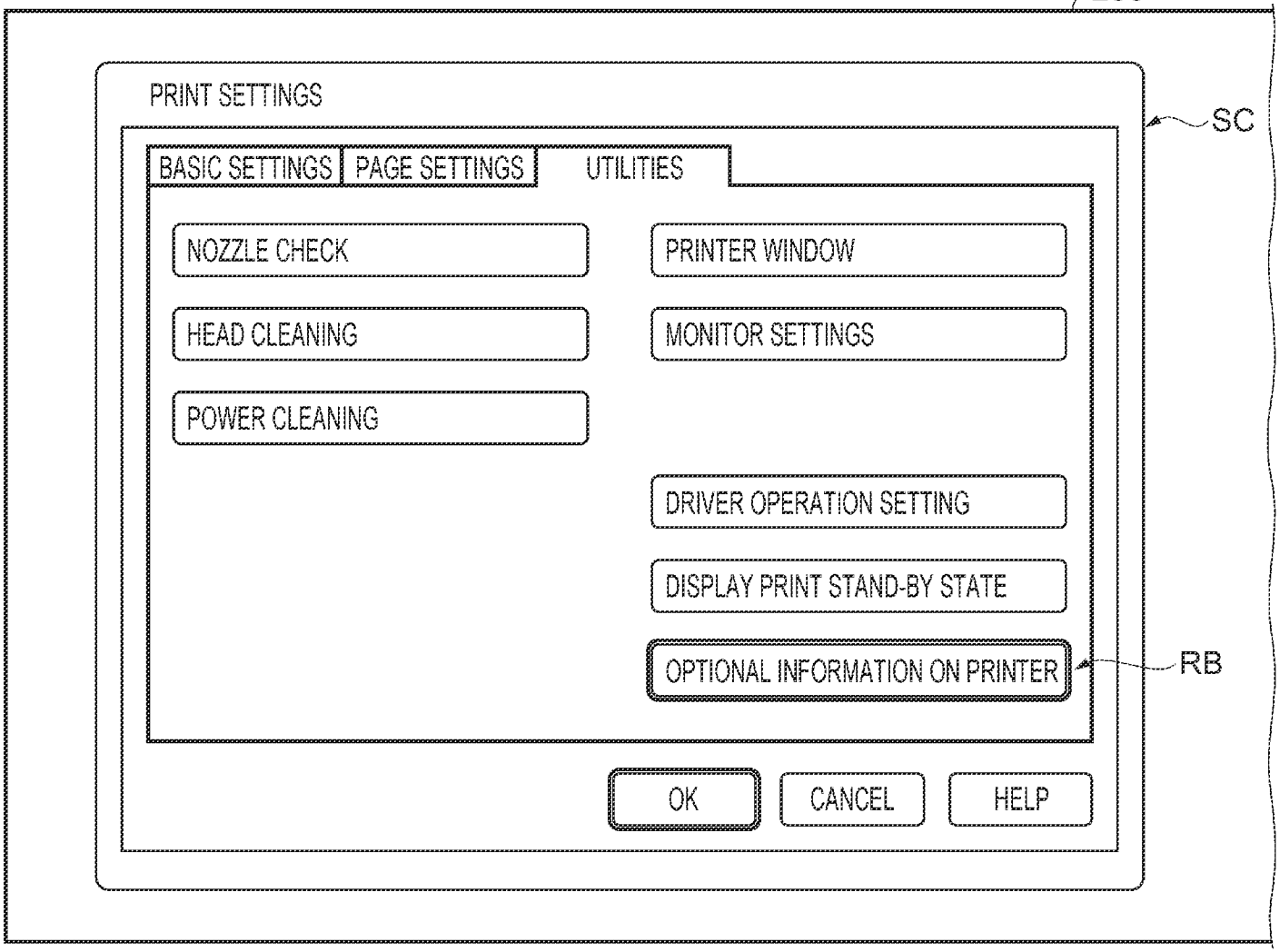
FIG. 19 is a schematic diagram illustrating the display unit displaying another setting screen.

For example, when the user selects a utility tab of a printer driver, the control unit 290 causes the display unit 206 to display the setting screen SC as illustrated in FIG. 19. When the user selects "optional information on printer" in the radio button unit RB and then selects "OK", the control unit 290 determines that there is the request from the user for display of the number of transported sheets by the feeding unit 73. In this case, step S201 turns out to be yes and the control unit 290 moves the processing to step S202. When there is no selection of the radio button unit RB as mentioned above, the control unit 290 determines that there is no request from the user for the display of the number of transported sheets by the feeding unit 73. In this case, step S201 turns out to be no and the control unit 290 terminates the processing.

Figure 21:
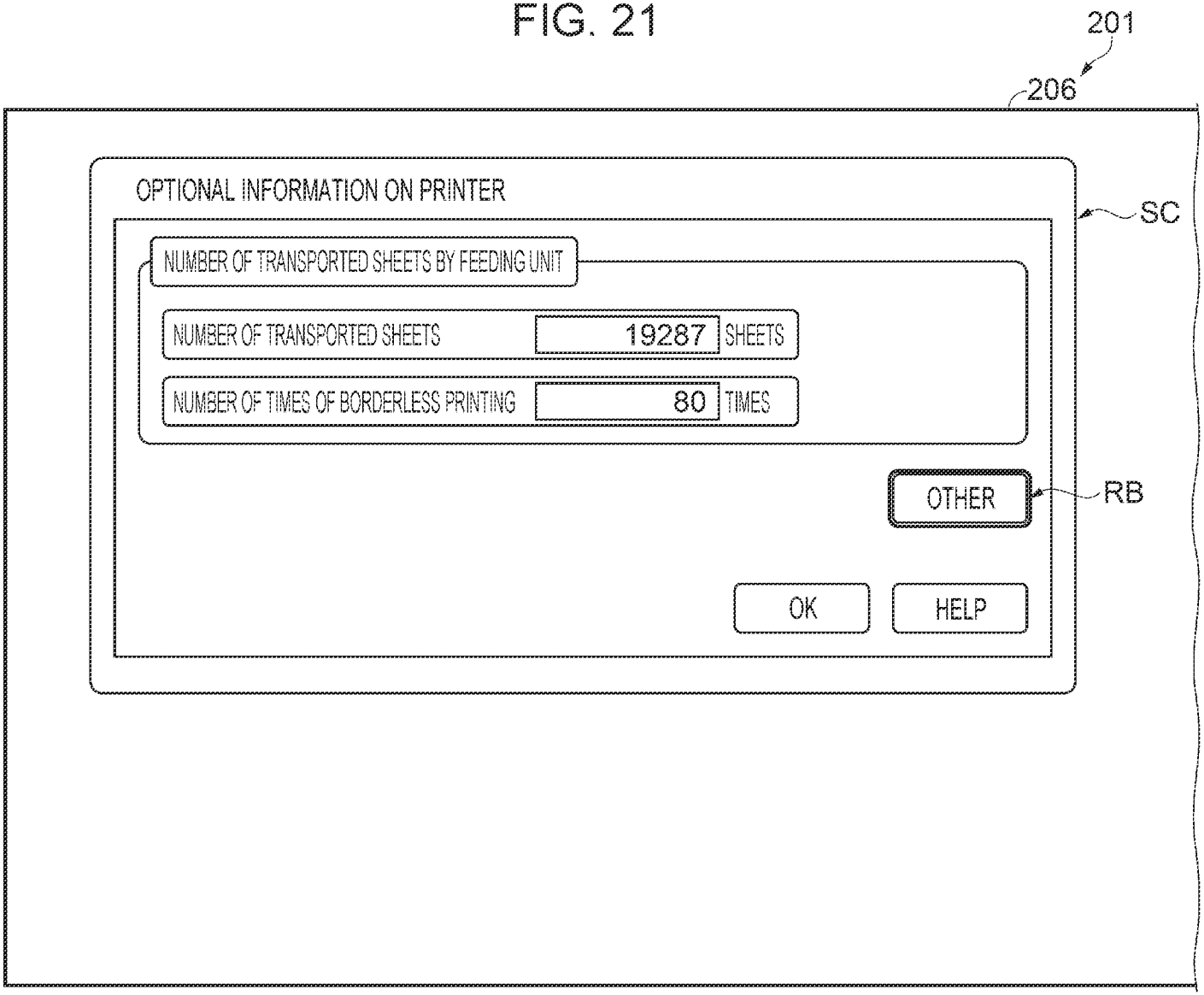
FIG. 21 is a schematic diagram illustrating the display unit displaying another setting screen.

In step S202, the control unit 290 displays the number of transported sheets by the feeding unit 73. The control unit 290 causes the display unit 206 to display the setting screen SC as illustrated in FIG. 21, for example. The setting screen SC illustrated in FIG. 21 displays the "number of transported sheets" that represents the number of the sheets S transported by the feeding unit 73. The "number of transported sheets" is equivalent to the feed counter value N that the control unit 290 obtains from the memory 92. In other words, the control unit 290 obtains the number of the sheets S transported by the feeding unit 73 from the memory 92, and causes the display unit 206 to display the number of the sheets S transported by the feeding unit 73.

In the present embodiment, the setting screen SC illustrated in FIG. 21 displays the "number of times of borderless printing" that represents the number of times of borderless printing in which the printing unit 30 performed the printing beyond outer edges of the sheets S. The number of times of borderless printing carried out by the printing unit 30 is stored in the form of a counter value in the memory 92 as with the feed counter value N. After carrying out the processing in step S202, the control unit 290 moves the processing to step S203. Note that the borderless printing is included in a predetermined printing aspect out of printing aspects to be carried out on the sheet S by the printing unit 30.

Figure 20:
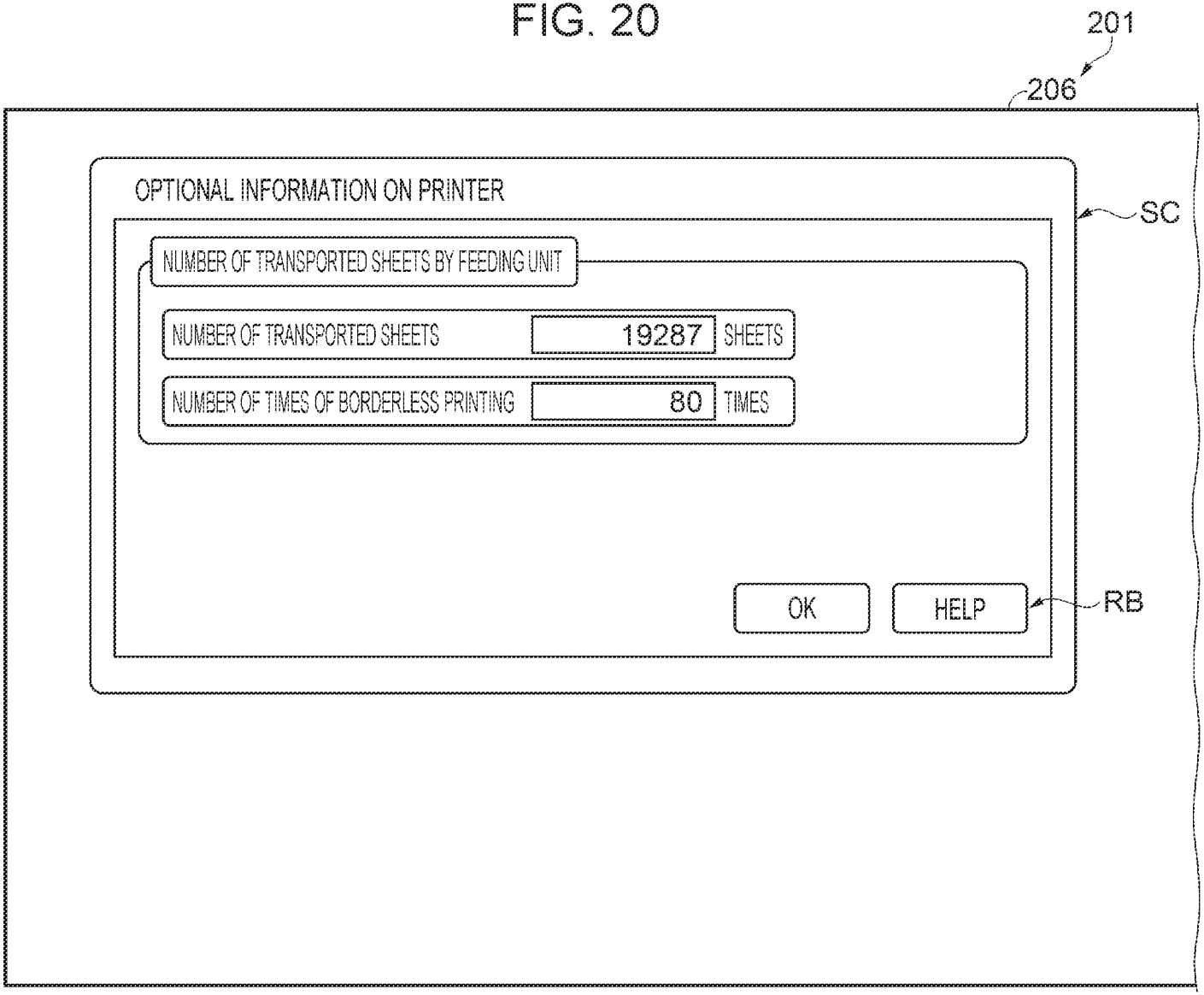
FIG. 20 is a schematic diagram illustrating the display unit displaying another setting screen.

When the "number of transported sheets" and the "number of times of borderless printing" are displayed as the information concerning the replacement of the feeding unit 73 in step S202, the control unit 290 may cause the display unit 206 to display the setting screen SC as illustrated in FIG. 20, for example.

In step S203, the control unit 290 checks whether or not there is a further request for display of the information concerning the replacement of the feeding unit 73. Specifically, the control unit 290 checks whether or not there is input by the user to request for further display of the information concerning the replacement of the feeding unit 73 in addition to the "number of transported sheets" and the "number of times of borderless printing".

For example, when the user selects "other" in the radio button unit RB in FIG. 21, the control unit 290 determines that there is the further request from the user for display of the information concerning the replacement of the feeding unit 73. In this case, the step S203 turns out to be yes and the control unit 290 moves the processing to step S205. When there is no selection of the radio button unit RB as mentioned above, the control unit 290 determines that there is no further request from the user for display of the information concerning the replacement of the feeding unit 73. In this case, step S203 turns out to be no and the control unit 290 moves the processing to step S204.

In step S204, the control unit 290 checks whether or not there is a request for termination of the display. Specifically, when the user selects "ok" in the radio button unit RB in FIG. 21, the control unit 290 determines that there is the request from the user for termination of the display of the information concerning the replacement of the feeding unit 73. In this case, the step S204 turns out to be yes and the control unit 290 terminates the processing. When there is no selection of the radio button unit RB, the step S204 turns out to be no and the control unit 290 continues the display of the setting screen SC illustrated in FIG. 21.

Figure 22:
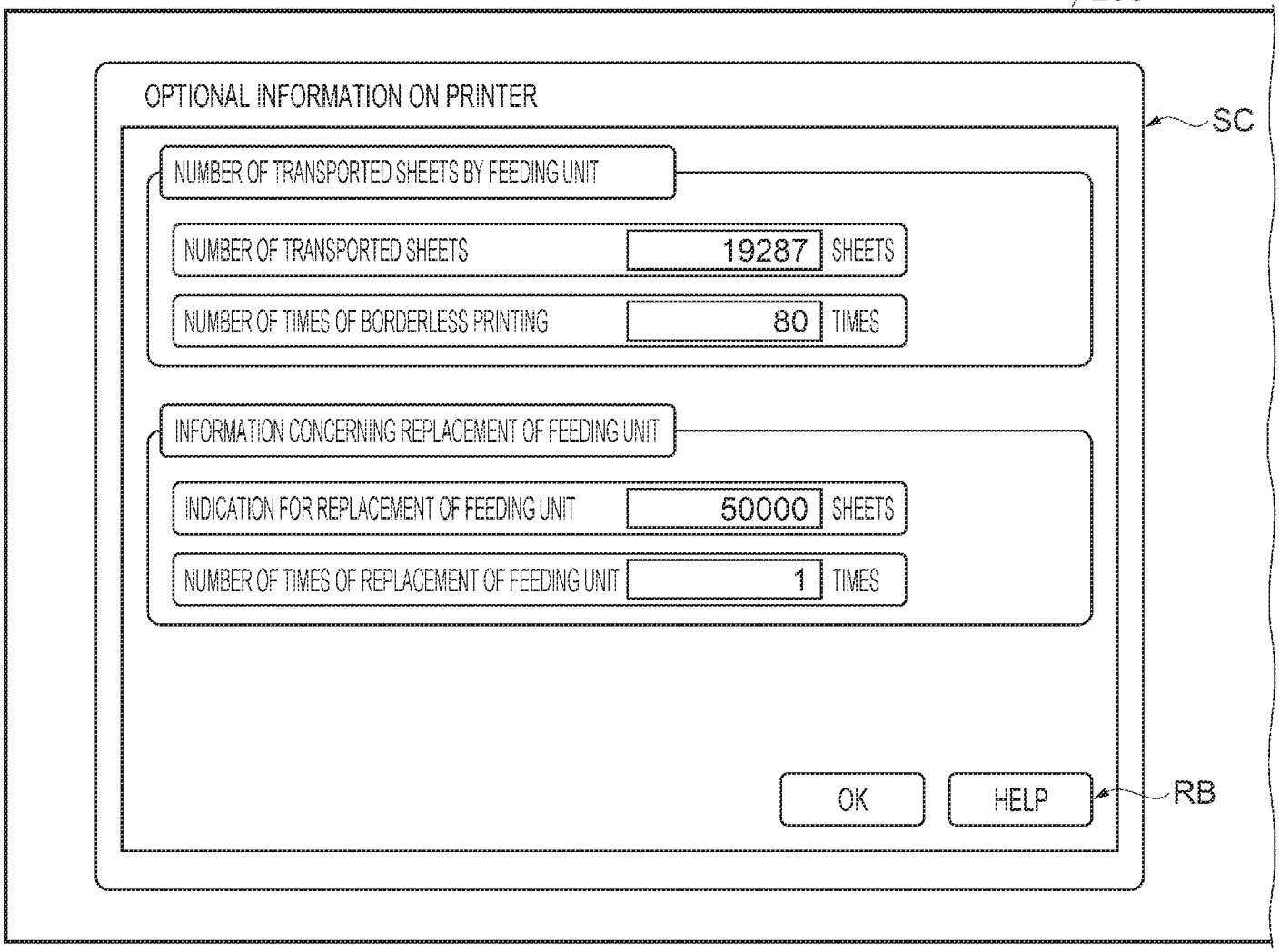
FIG. 22 is a schematic diagram illustrating the display unit displaying another setting screen.

In step S205, the control unit 290 displays the information concerning the replacement of the feeding unit 73. For example, the control unit 290 causes the display unit 206 to display the setting screen SC as illustrated in FIG. 22. The setting screen SC illustrated in FIG. 22 displays the "number of transported sheets" as well as the "number of times of borderless printing" mentioned above, the number of sheets of an "indication for replacement of feeding unit", and the "number of times of replacement of feeding unit". The number of sheets of the "indication for replacement of feeding unit" is equivalent to the second threshold Ne being the life information LJ stored in the memory 92. The control unit 290 obtains the second threshold Ne being the life information LJ stored in the memory 92, and displays the value in the display unit 206 as the number of sheets of the "indication for replacement of feeding unit". The "number of times of replacement of feeding unit" is the number of times of replacement of the feeding unit 73 which is stored in the form of a counter value in the memory 92 as with the second threshold Ne.

Figure 23:
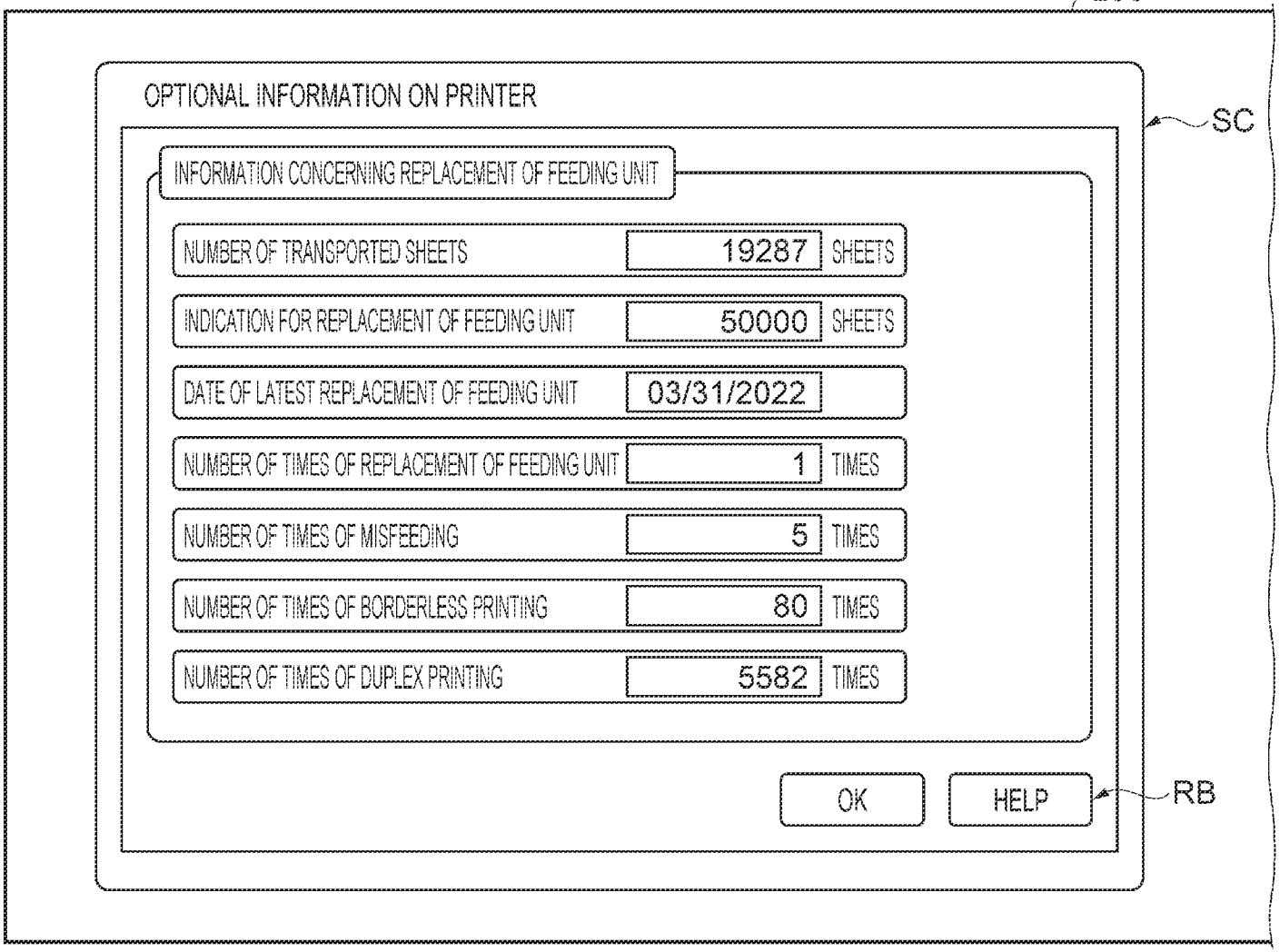
FIG. 23 is a schematic diagram illustrating the display unit displaying another setting screen.

Note that the "number of transported sheets" and the "number of times of borderless printing" do not have to be displayed on the setting screen SC illustrated in FIG. 22. Alternatively, in step S205, the control unit 290 may cause the display unit 206 to display the setting screen SC as illustrated in FIG. 23. The setting screen SC illustrated in FIG. 23 displays the "number of transported sheets", the "number of times of borderless printing", the number of sheets of the "indication for replacement of feeding unit", and the "number of times of replacement of feeding unit" as described above, and moreover, year, month, and day of a "date of latest replacement of feeding unit", the "number of times of misfeeding", and the "number of times of duplex printing". In the meantime, regarding the setting screen SC illustrated in FIG. 23, a piece of information which is more probably referred to when the user determines the timing to replace the feeding unit 73 is displayed at a higher position on the setting screen SC.

The year, month, and day of the "date of latest replacement of feeding unit" are the year, month, and day when the feeding unit 73 was replaced last time, which are stored in the form of a counter value in the memory 92. The "number of times of misfeeding" is the number of times of failures of the feeding unit 73 to transport the sheets S, which is stored in the form of a counter value in the memory 92. The misfeeding includes non-feeding in which the feeding unit 73 does not transport the sheet S from the sheet feeder tray 60, multi-feeding in which the feeding unit 73 feeds two or more sheets S from the sheet feeder tray 60 at one time, jamming in which the transported sheet S is stuck on the transportation route 17, and so forth. The control unit 290 obtains the counter value for the number of times of misfeeding stored in the memory 92, and causes the display unit 206 to display the number of times of misfeeding. The "number of times of duplex printing" is the number of times of duplex printing in which the printing unit 30 prints on two surfaces of the sheet S. This value is stored in the form of a counter value in the memory 92. Note that the "number of times of duplex printing" is included in the predetermined printing aspect out of the printing aspects to be carried out on the sheet S by the printing unit 30.

After carrying out the processing in step S205, the control unit 290 moves the processing to step S206. In step S206, the control unit 290 checks whether or not there is a request for termination of the display. Specifically, when there is no selection of the radio button unit RB, the step S206 turns out to be no and the control unit 290 continues the display of the setting screen SC illustrated in FIG. 22 or FIG. 23. When the user selects "ok" in the radio button unit RB in FIG. 22 or FIG. 23, the control unit 290 determines that there is the request from the user for termination of the display of the information concerning the replacement of the feeding unit 73. In this case, the step S206 turns out to be yes and the control unit 290 terminates the processing when displaying the information concerning the replacement of the feeding unit 73.

When the control unit 90 included in the printing apparatus 1 or the feeding device 2 is not coupled to the control unit 290 of the external device 201, the processing to be carried out by the control unit 290 when displaying the information concerning the replacement of the feeding unit 73 described by using FIGS. 18 to 23 is carried out by the control unit 90 instead. In this case, the control unit 90 displays the information concerning the replacement of the feeding unit 73 by executing the program stored in the memory 92. Moreover, in this case, a flow of processing when the control unit 90 displays the information concerning the replacement of the feeding unit 73 corresponds to the method of controlling the feeding device. In this case, the control unit 90 causes the display unit 6 to display the setting screens SC illustrated in FIGS. 19 to 23.

In this case, the processing to be carried out by the control unit 90 when displaying the information concerning the replacement of the feeding unit 73 corresponds to the processing to be carried out when the feeding device 2 displays the information concerning the replacement of the feeding unit 73. Meanwhile, a program to be executed either by the control unit 90 or by the control unit 290 of the external device 201 coupled to the control unit 90 when displaying the information concerning replacement of the feeding unit 73 corresponds to a program for causing the control unit 90 or the control unit 290 to control the feeding device 2 including the replaceable feeding unit 73 that transports the sheet S.

As described above, the feeding system, the feeding device, the method of controlling the feeding device, and the program according to the Embodiment 1 can bring about the following advantageous effects.

The system 501 includes the feeding device 2 provided with the replaceable feeding unit 73 that transports the sheet S, the external device 201 coupled to the feeding device 2 and provided with the control unit 290, and the display unit 206. The control unit 290 obtains the number of the sheets S transported by the feeding unit 73, and causes the display unit 206 to display the number of the sheets S transported by the feeding unit 73. In this case, the use checks the number of the sheets S transported by the feeding unit 73, so that the user can determine the timing to replace the feeding unit 73 based on the user's indication of replacement. According to this configuration, it is possible to suppress the replacement of the feeding unit 73 in the state of the transportation performance higher than the transportation performance that the user expects from the feeding unit 73, and to suppress the use of the feeding unit 73 having the transportation performance lower than the transportation performance that the user expects from the feeding unit 73 without replacing the feeding unit 73. As a consequence, the system 501 can provide the user with usability.

The control unit 290 is capable of causing the display unit 206 to display the message to promote the replacement of the feeding unit 73 based on the number of the sheets S transported by the feeding unit 73, and of setting whether or not it is appropriate to cause the display unit 206 to display the message to promote the replacement of the feeding unit 73. According to this configuration, the system 501 withholds the display of the message to promote the replacement of the feeding unit 73 based on the indication of replacement set by the system 501. Thus, it is possible to inhibit the user from replacing the feeding unit 73 even when the feeding unit 73 still has the life on the occasion that the life of the feeding unit 73 varies depending on the type of the sheets S used by the user, environmental factors, and so forth. On the other hand, when the user's indication of replacement matches the indication of replacement set by the system 501, the display of the message to promote the replacement of the feeding unit 73 enables the user to replace the feeding unit 73 at the appropriate timing.

The control unit 290 obtains the life information LJ concerning the life of the feeding unit 73 and causes the display unit 206 to display the life information LJ concerning the life of the feeding unit 73. According to this configuration, the user can appropriately determine whether or not the timing to replace the feeding unit 73 is close by comparing the user's indication of replacement with the life information LJ concerning the life of the feeding unit 73.

The control unit 290 obtains the number of times of misfeeding that represents the number of times of failures of the feeding unit 73 to transport the sheets S, and causes the display unit 206 to display the number of times of misfeeding. According to this configuration, the user can appropriately determine whether or not the timing to replace the feeding unit 73 is close by taking into account the number of times of misfeeding.

The system 501 includes the printing unit 30 that performs printing on the sheet S transported by the feeding unit 73. The printing unit 30 can perform the printing on the sheet S in accordance with the predetermined printing aspect, and the control unit 290 causes the display unit 206 to display the number of times of printing by the printing unit 30 in accordance with the predetermined printing aspect. When the printing aspect varies, the degree of stains on the feed roller portion 73*a* of the feeding unit 73 attributed to dust and ink mist caused in the course of printing by the printing unit 30 varies as well, and this variation may result in the change in life of the feeding unit 73. Nonetheless, the user can appropriately determine whether or not the timing to replace the feeding unit 73 is close even in this case by taking into account the number of times of printing by the printing unit 30 in accordance with the predetermined printing aspect.

The predetermined printing aspect includes the borderless printing in which the printing unit 30 performs the printing beyond the outer edges of the sheet S. When the borderless printing is carried out, the ink mist is prone to be generated more in the course of the printing by the printing unit 30, whereby the feed roller portion 73*a* of the feeding unit 73 is prone to be stained more. Nonetheless, the user can appropriately determine whether or not the timing to replace the feeding unit 73 is close even in this case by taking into account the number of times of borderless printing.

The predetermined printing aspect includes the duplex printing in which the printing unit 30 performs the printing on two surfaces of the sheet S. When the feeding device 2 carries out the duplex printing, the sheet S subjected to the printing on one of the surfaces is mounted on the mounting surface 61 such that the printed surface comes into contact with another sheet S mounted on the mounting surface 61 and with the feed driven roller 72. Then, the duplex printing may take place by causing the printing unit 30 to print on the other surface of the sheet S transported by the feeding unit 73. When the duplex printing is carried out as described above, the ink adhering to the sheet S mounted on the mounting surface 61 or to the feed driven roller 72 may be transferred to the feed roller portion 73*a* of the feeding unit 73 and may bring about stains as a result of contact with the printed surface of the sheet S. Nonetheless, the user can appropriately determine whether or not the timing to replace the feeding unit 73 is close even in this case by taking into account the number of times of duplex printing.

The feeding device 2 includes the sheet feeder tray 60 that mounts the sheet S, the feeding unit 73 that transports the sheet S from the sheet feeder tray 60, the control unit 90, and the display unit 6. The control unit 90 counts the number of the sheets S transported by the feeding unit 73 and causes the display unit 6 to display the number of the sheets S transported by the feeding unit 73. In this case, the user can check the number of the sheets S transported by the feeding unit 73 and determine the timing to replace the feeding unit 73 based on the user's indication of replacement. According to this configuration, it is possible to suppress the replacement of the feeding unit 73 in the state of the transportation performance higher than the transportation performance that the user expects from the feeding unit 73, and to suppress the use of the feeding unit 73 having the transportation performance lower than the transportation performance that the user expects from the feeding unit 73 without replacing the feeding unit 73. As a consequence, the feeding device 2 can provide the user with usability.

The control unit 90 is capable of causing the display unit 6 to display the message to promote the replacement of the feeding unit 73 based on the number of the sheets S transported by the feeding unit 73, and of setting whether or not it is appropriate to cause the display unit 6 to display the message to promote the replacement of the feeding unit 73. According to this configuration, the control unit 90 withholds the display of the message to promote the replacement of the feeding unit 73 based on the indication of replacement obtained by the control unit 90. Thus, it is possible to inhibit the user from replacing the feeding unit 73 even when the feeding unit 73 still has the life on the occasion that the life of the feeding unit 73 varies depending on the type of the sheets S used by the user, environmental factors, and so forth. On the other hand, when the user's indication of replacement matches the indication of replacement obtained by the control unit 90, the display of the message to promote the replacement of the feeding unit 73 enables the user to replace the feeding unit 73 at the appropriate timing.

The method of controlling the feeding device is a method of controlling the feeding device 2 including the replaceable feeding unit 73 that transports the sheet S. The method includes counting the number of the sheets S transported by the feeding unit 73, and causing the display unit 6 to display the number of the sheets S transported by the feeding unit 73. In this case, the user can check the number of the sheets S transported by the feeding unit 73 and determine the timing to replace the feeding unit 73 based on the user's indication of replacement. According to this configuration, it is possible to suppress the replacement of the feeding unit 73 in the state of the transportation performance higher than the transportation performance that the user expects from the feeding unit 73, and to suppress the use of the feeding unit 73 having the transportation performance lower than the transportation performance that the user expects from the feeding unit 73 without replacing the feeding unit 73. As a consequence, the method can provide the user with usability.

The method of controlling the feeding device includes setting whether or not it is appropriate to display the message to promote the replacement of the feeding unit 73 based on the number of the sheets S transported by the feeding unit 73. According to this configuration, the user can replace the feeding unit 73 at the appropriate timing by switching between the setting to display the message to promote the replacement of the feeding unit 73 and the setting not to display the message in response to the request from the user.

The program is a program to cause any of the control units 90 and 290 to control the feeding device 2 that includes the replaceable feeding unit 73 that transports the sheet S. The program causes any of the control units 90 and 290 to count the number of the sheets S transported by the feeding unit 73, and to display the number of the sheets S transported by the feeding unit 73. In this case, the user can check the number of the sheets S transported by the feeding unit 73 and determine the timing to replace the feeding unit 73 based on the user's indication of replacement. According to this configuration, it is possible to suppress the replacement of the feeding unit 73 in the state of the transportation performance higher than the transportation performance that the user expects from the feeding unit 73, and to suppress the use of the feeding unit 73 having the transportation performance lower than the transportation performance that the user expects from the feeding unit 73 without replacing the feeding unit 73. As a consequence, the program can provide the user with usability.

The program further causes any of the control units 90 and 290 to set whether or not it is appropriate to display the message to promote the replacement of the feeding unit 73 based on the number of the sheets S transported by the feeding unit 73. According to this configuration, the user can replace the feeding unit 73 at the appropriate timing by switching between the setting to display the message to promote the replacement of the feeding unit 73 and the setting not to display the message in response to the request from the user.

The feeding system, the feeding device, the method of controlling the feeding device, and the program according to the above-described embodiment of the present disclosure are basically provided with the aforementioned configurations. However, it is by all means possible to modify or omit part of these configurations within the range not departing from the gist of the present disclosure. In the meantime, the above-mentioned embodiment and other embodiments to be described below may be carried out in combination as long as such a combination is not technically inconsistent. Now, other embodiments will be described below.

In the above-described embodiment, the external shape of the spindle 74*a* of the rotating shaft 74 constituting the feed driving roller 71 need not be the circular shape when viewed in the direction along the x axis. For example, the external shape of the spindle 74*a* may be the same shape as the engaging portion 74*b* when viewed in the direction along the x axis. In this case, the rotating shaft 74 need not include the engaging portion 74*b*. Moreover, in this case, the engaged portion 73*b* of the feeding unit 73 is deemed to be engaged with the spindle 74*a* of the rotating shaft 74.

In the above-described embodiment, the home position of the feeding unit 73 may be such a position that the detachment direction T is oriented to the inner side surface 10*w* of the housing 10 and the detachment port 73*e* of the feeding unit 73 is oriented to the mounting surface 61 of the sheet feeder tray 60.

In the above-described embodiment, when the feeding unit 73 is located at the home position, the detachment direction T need not be oriented to the inner side surface 10*w* of the housing 10 unless the detachment unless the detachment direction T is oriented to the opening 10*h*. For example, when the feeding unit 73 is located at the home position, the detachment direction T may be oriented to the upper surface or a bottom surface of the housing 10 or may be oriented to the mounting surface 61 of the sheet feeder tray 60. In this case, the upper surface or the bottom surface of the housing 10 is an example of the region of the housing 10 which is different from the opening 10*h*.

In the above-described embodiment, a sheet feed sensor that can detect the sheet S mounted on the sheet feeder tray 60 may be provided. Moreover, the control unit 90 may display the message to promote the processing to remove the sheet S on the sheet feeder tray 60 when the sheet S is detected with the sheet feed sensor. In this case, the control unit 90 need not carry out the processing in step S16 of the flowcharts illustrated in FIGS. 11 and 12 when the sheet feed sensor does not detect the sheet S.

In the above-described embodiment, the housing 10 need not include the upper surface located on the +z direction side. In this case, the housing 10 need not include the opening 10*h*.

In the above-described embodiment, the printing apparatus 1 or the feeding device 2 need not include the opening-closing member 11.

In the above-described embodiment, when the printing apparatus 1 or the feeding device 2 is coupled to the external device 201, the operating buttons 4*a*, 4*b*, and 4*c* need not be used when replacing the feeding unit 73. For example, when replacing the feeding unit 73, the user may input the intention to replace the feeding unit 73 or the completion of the replacement of the feeding unit 73 by pressing input keys on a keyboard provided to the external device 201.

In the above-described embodiment, the operating panel 4 may include a feeding unit replacement button to be used when replacing the feeding unit 73, in addition to the operating buttons 4*p*, 4*a*, 4*b*, and 4*c* as well as the light-emitting portions 5*a*, 5*b*, and 5*c*. In this case, the user may input the intention to replace the feeding unit 73 or the completion of the replacement of the feeding unit 73 by pressing feeding unit replacement button in the course of replacement of the feeding unit 73.

In the above-described embodiment, the replacement of the feeding unit 73 by the user may be carried out in the state where the printing apparatus 1 or the feeding device 2 is powered off. For example, when the printing apparatus 1 or the feeding device 2 does not include the display unit 6 and is not coupled to the external device 201, the control unit 90 turns off the power to the printing apparatus 1 or the feeding device 2 in the state where the feeding unit 73 is located at the replacement position, by causing the user to press the operating button 4*p* after the control unit 90 moves the feeding unit 73 to the replacement position in step S18 of the flowchart shown in FIG. 11 or 12. Then, when the user completes the replacement of the feeding unit 73 and presses the operating button 4*p*, the control unit 90 moves the feeding unit 73 to the home position in step S23.

In the above-described embodiment, the "number of transported sheets" displayed on the setting screen SC need not be equal to the feed counter value N stored in the memory 92. For example, the value may be equal to a counter value which is counted based on print jobs sent to the control unit 90 from the control unit 290 of the external device 201 that is coupled to the control unit 90, and is stored in the memory 92 or the memory 292.

In the above-described embodiment, the first threshold Nn and the second threshold Ne being the life information LJ to be displayed on the setting screen SC as the number of sheets of the "indication for replacement of feeding unit" need not be stored in the memory 92. For example, these values may be stored in the program to be executed when displaying the information concerning the replacement of the feeding unit 73, which is stored in the memory 292 of the external device 201.

In the above-described embodiment, the control unit 290 need not display the new setting screen SC in order to display the information concerning the replacement of the feeding unit 73 as illustrated in FIG. 22 or FIG. 23. For example, when the information concerning the replacement of the feeding unit 73 is displayed in step S205 of the flowchart illustrated in FIG. 18, the control unit 290 may display the information concerning the replacement of the feeding unit 73 which is similar to the information in FIG. 22 or FIG. 23 by enlarging the setting screen SC illustrated in FIG. 21.

In the above-described embodiment, the predetermined printing aspect in the information concerning the replacement of the feeding unit 73 to be displayed on the setting screen SC may further include the number of times of printing in which the printing unit 30 carries out printing in accordance with high-definition printing having high printing quality. The high-definition printing uses a large amount of ink droplets that are smaller than those used when printing at standard quality, for instance. Accordingly, the high-definition printing is prone to generate more ink mist.

In the above-described embodiment, the number of the sheets S of a type prone to adhesion of paper powder which are transported by the feeding unit 73 may be displayed as the information concerning the replacement of the feeding unit 73 to be displayed on the setting screen SC. Examples of the paper prone to adhesion of paper powder includes coated paper provided with a coating, and the like.

In the above-described embodiment, the number of times of printing on a medium different from the sheet S may be displayed as the information concerning the replacement of the feeding unit 73 to be displayed on the setting screen SC. For example, the number of times of printing on the cards C and the number of times of printing on the discs D may be displayed on the setting screen SC illustrated in FIG. 23.

In the above-described embodiment, the user need not use the operating buttons 4*a* and 4*b* when the user switches between the setting not to display the annunciation of the state of the feeding unit 73 or the message to promote the replacement of the feeding unit 73 and the setting to display the annunciation of the state of the feeding unit 73 as well as the message to promote the replacement of the feeding unit 73. For example, the user may cause any of the display unit 206 and the display unit 6 to display the setting screen SC illustrated in FIG. 23, and select the "ok" and "help" in the radio button unit RB simultaneously. In this way, the control unit 290 or the control unit 90 may determine that there is the input by the user to request for the above-mentioned switching of the settings. In the meantime, when the control unit 90 is coupled to the external device 201, for example, the user may press the input keys on the keyboard provided to the external device 201. In this way, the control unit 290 or the control unit 90 may determine that there is the input by the user to request for the above-mentioned switching of the settings.

As described above, the feeding device, the printing apparatus, and the method of controlling the feeding device according to the Embodiments can bring about the following advantageous effects.

The feeding device 2 includes: the housing 10; the sheet feeder tray 60 that mounts the sheet S; the feeding unit 73 which transports the sheet S from the sheet feeder tray 60, includes the feed roller portion 73*a* that comes into contact with the sheet S and transports the sheet S and the engaged portion 73*b* to be engaged with the engaging portion 74*b* provided to the rotating shaft 74 that rotates the feed roller portion 73*a*, and is detachable from the rotating shaft 74; and the control unit 90 that controls rotation of the feeding unit 73. The feeding unit 73 is provided in the housing 10 in such a way as to be turnable to the home position to transport the sheet S mounted on the sheet feeder tray 60 and to the replacement position to enable detachment from the rotating shaft 74. When replacing the feeding unit 73, the control unit 90 switches the position of the feeding unit 73 to the replacement position. According to this configuration, the control unit 90 turns the feeding unit 73 to the replacement position and facilitates the replacement of the feeding unit 73. As a consequence, the feeding device 2 can provide the user with usability.

The housing 10 includes the opening 10*h* that exposes the feeding unit 73 to the outside. The mounting surface 61 of the sheet feeder tray 60 to mount the sheet S is disposed along the direction of transportation of the sheet S and is inclined relative to the vertical direction. When the feeding unit 73 is located at the replacement position, the detachment direction T in which the feeding unit 73 is detached from the rotating shaft 74 is oriented to the opening 10*h*. When the feeding unit 73 is located at the home position, the detachment direction T is oriented to the inner side surface 10*w* of the housing 10. According to this configuration, the user can easily replace the feeding unit 73 through the opening 10*h* when the feeding unit 73 is located at the replacement position. Meanwhile, when the feeding unit 73 is located at the home position, it is possible to inhibit the user from erroneously detaching the feeding unit 73 located at the home position.

The printing apparatus 1 includes the instruction acceptance unit IP that accepts the instruction from the user, and the control unit 90 switches the position of the feeding unit 73 to the replacement position after accepting the instruction to replace the feeding unit 73 from the instruction acceptance unit IP. This configuration improves usability of the user.

The instruction acceptance unit IP includes the display unit 6. After accepting the instruction to replace the feeding unit 73 from the instruction acceptance unit IP, the control unit 90 causes the display unit 6 to display the message to promote confirmation as to whether or not the sheet S is mounted on the sheet feeder tray 60. According to this configuration, it is possible to keep the sheet S mounted on the sheet feeder tray 60 from being transported due to the operation to switch the position of the feeding unit 73 to the replacement position.

The instruction acceptance unit IP is provided with operating buttons 4*a*, 4*b*, and 4*c*. When at least two operating buttons out of the operating buttons 4*a*, 4*b*, and 4*c* are pressed, the control unit 90 determines that there is the instruction to replace the feeding unit 73. According to this configuration, it is possible to suppress the movement of the feeding unit 73 to the replacement position by pressing the operating button by mistake as compared to the configuration to press one operating button, for example. Moreover, according to this configuration, it is unlikely to press the button by mistake as compared to the case of pressing the radio button unit RB displayed on the display unit 6.

When at least two operating buttons out of the operating buttons 4*a*, 4*b*, and 4*c* are pressed, the control unit 90 determines that the replacement of the feeding unit 73 is completed. According to this configuration, it is possible to suppress the movement of the feeding unit 73 from the replacement position by pressing the operating button by mistake in the course of replacing the feeding unit 73 as compared to the configuration to press one operating button, for example. Moreover, according to this configuration, it is unlikely to press the button by mistake as compared to the case of pressing the radio button unit RB displayed on the display unit 6.

When the feeding unit 73 is replaced and the feeding unit 73 is attached to the rotating shaft 74, the control unit 90 turns the feeding unit 73 to the home position. When the feeding unit 73 is moved to the home position after mounting the sheet S on the sheet feeder tray 60, an amount of transportation of the sheet S varies with a turned amount of the feeding unit 73 from the replacement position to the home position. On the other hand, the control unit 90 returns the feeding unit 73 attached to the rotating shaft 74 to the home position before mounting the sheet S on the sheet feeder tray 60. Accordingly, the sheet S mounted on the sheet feeder tray 60 can be appropriately transported.

The printing apparatus 1 includes the opening-closing member 11, which has the center of rotation on the −y direction side in the y-axis direction of the housing 10, and is provided in such a way as to be capable of opening and closing the upper part of the housing 10. The feeding unit 73 is provided on the −y direction side in the y-axis direction of the housing 10. The instruction acceptance unit IP is provided at the end in the +x direction of the housing 10 in the x-axis direction intersecting with the y-axis direction of the housing 10. In the y-axis direction, the instruction acceptance unit IP is provided at the position being located on the +y direction side and not overlapping the feeding unit 73. According to this configuration, it is possible to suppress an erroneous operation such as movement of the feeding unit 73 from the replacement position attributed to the user touching the instruction acceptance unit IP by mistake in the course of the replacement operation of the feeding unit 73.

The feeding unit 73 includes the operating portion 73*f* that is movable in the x-axis direction. By moving the operating portion 73*f*, the feeding unit 73 can be detached from the rotating shaft 74. According to this configuration, it is possible to replace the feeding unit 73 easily.

The control unit 90 obtains the feed counter value N based on the number of the sheets S transported by the feeding unit 73 and the life information LJ concerning the life of the feeding unit 73, and causes the display unit 6 to display the message to promote the replacement of the feeding unit 73 based on the feed counter value N and the life information LJ. According to this configuration, the control unit 90 determines the timing to replace the feeding unit 73 and urges the user to conduct the replacement. Thus, it is possible to cause the user to replace the feeding unit 73 at the appropriate timing.

The life information LJ includes the first threshold Nn and the second threshold Ne being the value larger than the first threshold Nn. When the feed counter value N is equal to or above the first threshold Nn and below the second threshold Ne, the control unit 90 causes the display unit 6 to display the message to promote the replacement of the feeding unit 73. According to this configuration, the control unit 90 determines the timing to replace the feeding unit 73 and urges the user to conduct the replacement. Thus, it is possible to cause the user to replace the feeding unit 73 at the appropriate timing.

When the feed counter value N is equal to or above the second threshold Ne, the control unit 90 causes the display unit 6 to display the message to promote the replacement of the feeding unit 73 more than once. According to this configuration, it is possible to firmly urge the user to replace the feeding unit 73.

The printing apparatus 1 includes the feeding device 2 and the printing unit 30 that performs the printing on the transported sheet S. According to this configuration, the printing unit 30 can perform the printing on the sheet S that is appropriately transported by the feeding device 2.

The method of controlling the feeding device is the method of controlling the feeding device provided with: the sheet feeder tray 60 that mounts the sheet S; and the feeding unit 73 which transports the sheet S from the sheet feeder tray 60, includes the feed roller portion 73*a* that comes into contact with the sheet S and transports the sheet S and the engaged portion 73*b* to be engaged with the engaging portion 74*b* provided to the rotating shaft 74 that rotates the feed roller portion 73*a*, and is detachable from the rotating shaft 74. When replacing the feeding unit 73, the position of the feeding unit 73 is switched from the home position to transport the sheet S mounted on the sheet feeder tray 60 to the replacement position to enable detachment from the rotating shaft 74. According to this method, the feeding unit 73 is moved to the replacement position by the control of the feeding device, it is easy to replace the feeding unit 73. As a consequence, the method can provide the user with usability.

The feeding device, the printing apparatus, and the method of controlling the feeding device according to the embodiment of the present disclosure are based on provision of the above-described configurations. However, it is of course possible to conduct partial modification, omission, and the like of these configurations within the range not departing from the gist of the present disclosure. Meanwhile, the above-described embodiment and other embodiments to be discussed below may be carried out in combination within the range that is technically consistent. Now, such other embodiments will be described below.

In the above-described embodiment, the external shape of the spindle 74*a* of the rotating shaft 74 constituting the feed driving roller 71 need not be the circular shape when viewed in the direction along the x axis. For example, the external shape of the spindle 74*a* may be the same shape as the engaging portion 74*b* when viewed in the direction along the x axis. In this case, the rotating shaft 74 need not include the engaging portion 74*b*. Moreover, in this case, the engaged portion 73*b* of the feeding unit 73 is deemed to be engaged with the spindle 74*a* of the rotating shaft 74.

In the above-described embodiment, the home position of the feeding unit 73 may be such a position that the detachment direction T is oriented to the inner side surface 10*w* of the housing 10 and the detachment port 73*e* of the feeding unit 73 is oriented to the mounting surface 61 of the sheet feeder tray 60.

In the above-described embodiment, when the feeding unit 73 is located at the home position, the detachment direction T need not be oriented to the inner side surface 10*w* of the housing 10 unless the detachment direction T is oriented to the opening 10*h*. For example, when the feeding unit 73 is located at the home position, the detachment direction T may be oriented to the upper surface or a bottom surface of the housing 10 or may be oriented to the mounting surface 61 of the sheet feeder tray 60. In this case, the upper surface or the bottom surface of the housing 10 is an example of the region of the housing 10 which is different from the opening 10*h*.

In the above-described embodiment, a sheet feed sensor that can detect the sheet S mounted on the sheet feeder tray 60 may be provided. Moreover, the control unit 90 may display the message to promote the processing to remove the sheet S on the sheet feeder tray 60 when the sheet S is detected with the sheet feed sensor. In this case, the control unit 90 need not carry out the processing in step S16 of the flowcharts illustrated in FIGS. 11 and 12 when the sheet feed sensor does not detect the sheet S.

In the above-described embodiment, the housing 10 need not include the upper surface located on the +z direction side. In this case, the housing 10 need not include the opening 10*h*.

In the above-described embodiment, the printing apparatus 1 need not include the opening-closing member 11.

In the above-described embodiment, when the printing apparatus 1 is coupled to the external device 201, the operating buttons 4*a*, 4*b*, and 4*c* need not be used when replacing the feeding unit 73. For example, when replacing the feeding unit 73, the user may input the intention to replace the feeding unit 73 or the completion of the replacement of the feeding unit 73 by pressing input keys on a keyboard provided to the external device 201.

In the above-described embodiment, the operating panel 4 may include a feeding unit replacement button to be used when replacing the feeding unit 73, in addition to the operating buttons 4*p*, 4*a*, 4*b*, and 4*c* as well as the light-emitting portions 5*a*, 5*b*, and 5*c*. In this case, the user may input the intention to replace the feeding unit 73 or the completion of the replacement of the feeding unit 73 by pressing the feeding unit replacement button in the course of replacement of the feeding unit 73, for example.

APPENDIX

[1] A feeding system comprising:
a feeding device including a replaceable feeding unit that transports a medium;
an external device coupled to the feeding device and including a control unit; and
a display unit, wherein
the control unit obtains number of the media transported by the feeding unit, and
the control unit causes the display unit to display the number of the media transported by the feeding unit.

[2] The feeding system according to [1], wherein
the control unit is configured to cause the display unit to display a message to promote replacement of the feeding unit based on the number of the media transported by the feeding unit, and
the control unit is configured to set whether or not it is appropriate to cause the display unit to display the message to promote the replacement of the feeding unit.

[3] The feeding system according to [1] or [2], wherein
the control unit obtains life information concerning a life of the feeding unit, and
the control unit causes the display unit to display the life information concerning the life of the feeding unit.

[4] The feeding system according to any one of [1] to [3], wherein
the control unit obtains number of times of misfeeding that represents number of times of failures of the feeding unit to transport the media, and
the control unit causes the display unit to display the number of times of misfeeding.

[5] The feeding system according to any one of [1] to [4], further comprising:
a printing unit that performs printing on the medium transported by the feeding unit, wherein
the printing unit is configured to perform the printing on the medium in accordance with a predetermined printing aspect, and
the control unit causes the display unit to display number of times of printing by the printing unit in accordance with the predetermined printing aspect.

[6] The feeding system according to [5], wherein the predetermined printing aspect includes borderless printing in which the printing unit performs the printing beyond an outer edge of the medium.

[7] The feeding system according to [5] or [6], wherein the predetermined printing aspect includes duplex printing in which the printing unit performs the printing on two surfaces of the medium.

[8] A feeding device comprising:
a mounting unit that mounts a medium;
a feeding unit that transports the medium from the mounting unit;
a control unit; and
a display unit, wherein
the control unit counts number of the media transported by the feeding unit, and
the control unit causes the display unit to display the number of the media transported by the feeding unit.

[9] The feeding device according to [8], wherein
the control unit is configured to cause the display unit to display a message to promote replacement of the feeding unit based on the number of the media transported by the feeding unit, and
the control unit is configured to set whether or not it is appropriate to cause the display unit to display the message to promote the replacement of the feeding unit.

[10] A method of controlling a feeding device provided with a replaceable feeding unit that transports a medium, the method comprising:
counting number of the media transported by the feeding unit; and
displaying the number of the media transported by the feeding unit.

[11] The method of controlling a feeding device according to [10], further comprising:
setting whether or not it is appropriate to display a message to promote replacement of the feeding unit based on the number of the media transported by the feeding unit.

[12] A non-transitory computer-readable storage medium storing a program to cause a control unit to control a feeding device provided with a replaceable feeding unit that transports a medium, the program comprising:
causing the control unit to count number of the media transported by the feeding unit; and
causing the control unit to display the number of the media transported by the feeding unit.

[13] The non-transitory computer-readable storage medium storing the program according to [12], further comprising:
causing the control unit to set whether or not it is appropriate to display a message to promote replacement of the feeding unit based on the number of the media transported by the feeding unit.

The embodiment has been described above with reference to the drawings. However, specific configurations of the present disclosure are not limited only to those of the embodiment, and any of modification, replacement, omission, and the like of the configurations may be carried out within the range not departing from the gist of this disclosure.

What is claimed is:

1. A feeding device comprising:
a device body;
a mounting unit that mounts a medium;
a feeding unit that transports the medium from the mounting unit, the feeding unit being configured to be detached from a rotating shaft and including
a feed roller portion that comes into contact with the medium and transports the medium, and
an engaged portion to be engaged with an engaging portion provided to the rotating shaft that rotates the feed roller portion; and
a control unit that controls rotation of the feeding unit, wherein
the feeding unit is configured to be turned to a feeding position to transport the medium mounted on the mounting unit and to a replacement position to enable detachment from the rotating shaft,
the control unit switches a position of the feeding unit to the replacement position when replacing the feeding unit, and
the feeding unit is configured to be turned to the feeding position and to the replacement position around the rotating shaft.

2. The feeding device according to claim 1, wherein
the device body includes an opening that exposes the feeding unit to outside,
the mounting surface of the mounting unit to mount the medium is disposed along a direction of transportation of the medium and is inclined relative to a vertical direction,
when the feeding unit is located at the replacement position, a detachment direction in which the feeding unit is detached from the rotating shaft is oriented to the opening, and
when the feeding unit is located at the feeding position, the detachment direction is oriented to a region of the device body different from the opening.

3. The feeding device according to claim 1, further comprising:
an instruction acceptance unit that accepts an instruction from a user, wherein
the control unit switches the position of the feeding unit to the replacement position after accepting an instruction to replace the feeding unit from the instruction acceptance unit.

4. The feeding device according to claim 3, wherein
the instruction acceptance unit includes a display unit, and
after accepting the instruction to replace the feeding unit from the instruction acceptance unit, the control unit causes the display unit to display a message to promote confirmation as to whether or not the medium is mounted on the mounting unit.

5. The feeding device according to claim 3, wherein
the instruction acceptance unit includes a plurality of operating buttons, and
when at least two operating buttons out of the plurality of operating buttons are pressed, the control unit determines that there is the instruction to replace the feeding unit.

6. The feeding device according to claim 3, wherein
the instruction acceptance unit includes a plurality of operating buttons, and
when at least two operating buttons out of the plurality of operating buttons are pressed, the control unit determines that the replacement of the feeding unit is completed.

7. The feeding device according to claim 3, further comprising:
an opening-closing member having center of rotation on a back surface side in a depth direction of the device body, and being provided in such a way as to be configured to open and close an upper part of the device body, wherein
the feeding unit is provided on the back surface side in the depth direction of the device body,
the instruction acceptance unit is provided on one end side in a width direction intersecting with the depth direction of the device body, and provided at a position being located on a front surface side in the depth direction and not overlapping the feeding unit.

8. The feeding device according to claim 4, wherein
the control unit obtains
a feed counter value based on number of the media transported by the feeding unit, and
life information concerning life of the feeding unit, and
the control unit causes the display unit to display a message to promote replacement of the feeding unit based on the feed counter value and the life information.

9. The feeding device according to claim 8, wherein
the life information includes
a first threshold, and
a second threshold being a value larger than the first threshold, and
the control unit causes the display unit to display the message to promote the replacement of the feeding unit when the feed counter value is equal to or above the first threshold and is smaller than the second threshold.

10. The feeding device according to claim 9, wherein
the control unit causes the display unit to display the message to promote the replacement of the feeding unit more than once when the feed counter value is equal to or above the second threshold.

11. The feeding device according to claim 1, wherein
when the feeding unit is replaced and the feeding unit is attached to the rotating shaft, the control unit turns the feeding unit to the feeding position.

12. The feeding device according to claim 1, wherein
the feeding unit includes an operating portion configured to move in an axial direction of rotation of the feeding unit, and
the feeding unit is configured to be detached from the rotating shaft by movement of the operating portion.

13. A printing apparatus comprising:
the feeding device according to claim 1; and
a printing unit that performs printing on the transported medium.

14. A method of controlling a feeding device provided with a mounting unit that mounts a medium, a feeding unit that transports the medium from the mounting unit, the feeding unit being configured to be detached from a rotating shaft and including a feed roller portion that comes into contact with the medium and transports the medium, an engaged portion to be engaged with an engaging portion provided to the rotating shaft that rotates the feed roller portion, a motor that rotates the rotating shaft, the method comprising:
switching a position of the feeding unit from a feeding position to transport the medium mounted on the mounting unit to a replacement position to enable detachment from the rotating shaft when replacing the feeding unit by driving the motor.

15. A feeding device comprising:

a device body;

a mounting unit that mounts a medium;

a feeding unit that transports the medium from the mounting unit, the feeding unit being configured to be detached from a rotating shaft and including a feed roller portion that comes into contact with the medium and transports the medium, and an engaged portion to be engaged with an engaging portion provided to the rotating shaft that rotates the feed roller portion;

a control unit that controls rotation of the feeding unit; and an instruction acceptance unit that accepts an instruction from a user, wherein the feeding unit is configured to be turned to a feeding position to transport the medium mounted on the mounting unit and to a replacement position to enable detachment from the rotating shaft, the control unit switches a position of the feeding unit to the replacement position when replacing the feeding unit the control unit switches the position of the feeding unit to the replacement position after accepting an instruction to replace the feeding unit from the instruction acceptance unit.

16. The feeding device according to claim 15, wherein the instruction acceptance unit includes a display unit, and after accepting the instruction to replace the feeding unit from the instruction acceptance unit, the control unit causes the display unit to display a message to promote confirmation as to whether or not the medium is mounted on the mounting unit.

17. The feeding device according to claim 15, wherein the instruction acceptance unit includes a plurality of operating buttons, and when at least two operating buttons out of the plurality of operating buttons are pressed, the control unit determines that there is the instruction to replace the feeding unit.

18. The feeding device according to claim 15, wherein the instruction acceptance unit includes a plurality of operating buttons, and when at least two operating buttons out of the plurality of operating buttons are pressed, the control unit determines that the replacement of the feeding unit is completed.

19. The feeding device according to claim 15, further comprising:

an opening-closing member having center of rotation on a back surface side in a depth direction of the device body, and being provided in such a way as to be configured to open and close an upper part of the device body, wherein the feeding unit is provided on the back surface side in the depth direction of the device body, the instruction acceptance unit is provided on one end side in a width direction intersecting with the depth direction of the device body, and provided at a position being located on a front surface side in the depth direction and not overlapping the feeding unit.

* * * * *